US008210961B2

(12) United States Patent
Finn et al.

(10) Patent No.: US 8,210,961 B2
(45) Date of Patent: Jul. 3, 2012

(54) GOLF CLUB OR GOLF CLUB HEAD HAVING AN ADJUSTABLE BALL STRIKING FACE

(75) Inventors: Michael E. Finn, Fort Worth, TX (US); Andrew G. V. Oldknow, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 95 days.

(21) Appl. No.: 12/709,136

(22) Filed: Feb. 19, 2010

(65) Prior Publication Data

US 2011/0207552 A1 Aug. 25, 2011

(51) Int. Cl.
*A63B 69/36* (2006.01)
*A63B 53/06* (2006.01)
*A63B 53/08* (2006.01)

(52) U.S. Cl. ..... 473/244; 473/245; 473/246; 473/329; 473/342; 473/345; 473/346

(58) Field of Classification Search ..... 473/324–350, 473/287–292, 219–256
See application file for complete search history.

(56) References Cited

U.S. PATENT DOCUMENTS

| | | | | |
|---|---|---|---|---|
| 1,665,523 | A | 4/1928 | Boyce | |
| 2,175,598 | A | 10/1939 | Fedak | |
| 3,190,651 | A * | 6/1965 | Thomas | 473/245 |
| 3,212,783 | A | 10/1965 | Bradley et al. | |
| 3,589,731 | A * | 6/1971 | Chancellor, Jr. | 473/333 |
| 4,067,572 | A * | 1/1978 | Coleman | 473/245 |
| 5,176,383 | A * | 1/1993 | Duclos | 473/342 |
| 5,464,211 | A * | 11/1995 | Atkins, Sr. | 473/377 |
| 5,890,973 | A * | 4/1999 | Gamble | 473/326 |
| 5,908,356 | A * | 6/1999 | Nagamoto | 473/224 |
| 6,299,547 | B1 | 10/2001 | Kosmatka | |
| 6,354,956 | B1 * | 3/2002 | Doong | 473/219 |
| 6,386,987 | B1 | 5/2002 | Lejeune, Jr. | |
| 6,964,616 | B2 * | 11/2005 | Dombrowski | 473/239 |
| 7,140,977 | B2 * | 11/2006 | Atkins, Sr. | 473/346 |
| 7,247,104 | B2 * | 7/2007 | Poynor | 473/329 |

(Continued)

FOREIGN PATENT DOCUMENTS

JP 2142578 5/1990

(Continued)

OTHER PUBLICATIONS

International Search Report corresponding in PCT Application No. PCT/US2011/021682, mailed Sep. 1, 2011.

*Primary Examiner* — Sebastiano Passaniti
(74) *Attorney, Agent, or Firm* — Banner & Whitcoff, Ltd.

(57) ABSTRACT

This invention relates generally to golf clubs or golf club heads, having an adjustable ball striking face. The golf club head includes a club head body, a ball striking face, and a brace extending from a sole of the club head body to an inner surface of the ball striking face. The brace may further include an end portion engaged with the inner surface of the ball striking face, a fixed rod located between the end portion and an inner surface of the club head at the sole, a biasing member attached to the fixed rod. The biasing member may provide a biasing force to the ball striking face such that the ball striking face is adjustable between a first direction thereby adjusting a face angle of the club head and a second direction thereby adjusting a loft angle of the club head.

33 Claims, 15 Drawing Sheets

U.S. PATENT DOCUMENTS

| | | | | |
|---|---|---|---|---|
| 7,335,112 | B1 * | 2/2008 | Bitondo et al. | 473/238 |
| 7,722,477 | B2 * | 5/2010 | Consiglio | 473/332 |
| 7,914,393 | B2 * | 3/2011 | Hirsch et al. | 473/332 |
| 7,927,231 | B2 * | 4/2011 | Sato et al. | 473/334 |
| 7,967,700 | B2 * | 6/2011 | Stites | 473/342 |
| 2002/0169036 | A1 * | 11/2002 | Boone | 473/346 |
| 2003/0190975 | A1 | 10/2003 | Fagot | |
| 2008/0139335 | A1 * | 6/2008 | Tavares et al. | 473/332 |
| 2010/0273565 | A1 * | 10/2010 | Stites et al. | 473/282 |

FOREIGN PATENT DOCUMENTS

| | | |
|---|---|---|
| JP | 9024125 | 1/1997 |

* cited by examiner

GOLF CLUB OR GOLF CLUB HEAD HAVING AN ADJUSTABLE BALL STRIKING FACE

TECHNICAL FIELD

The invention relates generally to golf clubs or golf club heads, having an adjustable ball striking face. Certain aspects of this invention relate to golf clubs and golf club heads having a brace with a biasing member extending from the sole area of the club to a rear surface of the ball striking face.

BACKGROUND OF THE INVENTION

Golf is enjoyed by a wide variety of players—players of different genders, and players of dramatically different ages and skill levels. Golf is somewhat unique in the sporting world in that such diverse collections of players can play together in golf outings or events, even in direct competition with one another (e.g., using handicapped scoring, different tee boxes, etc.), and still enjoy the golf outing or competition. These factors, together with increased golf programming on television (e.g., golf tournaments, golf news, golf history, and/or other golf programming) and the rise of well known golf superstars, at least in part, have increased golfs popularity in recent years, both in the United States and across the world.

Golfers at all skill levels seek to improve their performance, lower their golf scores, and reach that next performance "level." Manufacturers of all types of golf equipment have responded to these demands, and recent years have seen dramatic changes and improvements in golf equipment. For example, a wide range of different golf ball models now are available, with some balls designed to fly farther and straighter, provide higher or flatter trajectory, provide more spin, control, and feel (particularly around the greens), etc.

Being the sole instrument that sets a golf ball in motion during play, the golf club also has been the subject of much technological research and advancement in recent years. For example, the market has seen improvements in golf club heads, shafts, and grips in recent years. Additionally, other technological advancements have been made in an effort to better match the various elements of the golf club and characteristics of a golf ball to a particular user's swing features or characteristics (e.g., club fitting technology, ball launch angle measurement technology, etc.).

Despite the various technological improvements, golf remains a difficult game to play at a high level. For a golf ball to reliably fly straight and in the desired direction, a golf club must meet the golf ball square (or substantially square) to the desired target path. Moreover, the golf club must meet the golf ball at or close to a desired location on the club head face (i.e., on or near a "desired" or "optimal" ball contact location) to reliably fly straight, in the desired direction, and for a desired distance. Off-center hits may tend to "twist" the club face when it contacts the ball, thereby sending the ball in the wrong direction, imparting undesired hook or slice spin, and/or robbing the shot of distance. Club face/ball contact that deviates from squared contact and/or is located away from the club's desired ball contact location, even by a relatively minor amount, also can launch the golf ball in the wrong direction, often with undesired hook or slice spin, and/or can rob the shot of distance. Accordingly, club head features that allow a user to make adjustments to the club to help the ball fly straighter and truer, in the desired direction, and with improved and/or reliable distance, would be welcome in the art.

The present device is provided to address the problems discussed above and other problems, and to provide advantages and aspects not provided by prior golf clubs or golf club heads of this type. A full discussion of the features and advantages of the present invention is deferred to the following detailed description, which proceeds with reference to the accompanying drawings.

SUMMARY OF THE INVENTION

The following presents a general summary of aspects of the invention in order to provide a basic understanding of the invention. This summary is not an extensive overview of the invention. It is not intended to identify key or critical elements of the invention or to delineate the scope of the invention. The following summary merely presents some concepts and aspects of the invention in a general form as a prelude to the more detailed description provided below.

Aspects of the invention relate to golf clubs and golf club heads, with a head comprising: a club head body having a front, a crown, a sole, and a face engaging area extending around the outer perimeter of the front of the club head body between the crown and the sole; a ball striking face configured for striking a ball with an outer surface thereof, wherein the ball striking face is configured to engage the face engaging area; a brace extending from the sole to a contact point on an inner surface of the ball striking face, wherein the brace includes a biasing member such that the ball striking face is adjustable between a first direction thereby adjusting a face angle of the club head and a second direction thereby adjusting a loft angle of the club head.

According to another aspect of the invention, a wood-type golf club head comprises: a club head body having a front, a crown, a sole, and a support rib extending around the outer perimeter of the front of the club head body between the crown and the sole; a ball striking face configured for striking a ball with an outer surface thereof, wherein the ball striking face is configured to engage the support rib; a brace extending from the sole to an inner surface of the ball striking face, wherein the brace includes: an end portion engaged with the inner surface of the ball striking face, a fixed rod located between the end portion and an inner surface of the club head at the sole, wherein the fixed rod also includes a retractable rod located within the fixed rod, and a biasing member attached to the retractable rod, wherein the biasing member surrounds at least a portion of the fixed rod and provides a biasing force to the ball striking face such that the ball striking face is adjustable between a first direction thereby adjusting a face angle of the club head and a second direction thereby adjusting a loft angle of the club head.

According to other aspects of this invention, the ball striking face may further include a plurality of adjustment points. Each of the plurality of adjustment points may comprise a screw that engages the ball striking face to the face engaging area. In one configuration, the plurality of adjustment points may include a first adjustment point located approximately at a high-heel area of the ball striking face, a second adjustment point located approximately at a high-toe area of the ball striking face, and a third adjustment point located approximately between a low-heel area and a low-toe area of the ball striking face. In a second configuration, the plurality of adjustment points may include a first adjustment point located approximately at a high-heel area of the ball striking face, a second adjustment point located approximately at a high-toe area of the ball striking face, a third adjustment point located approximately between a low-heel area and a low-toe area of the ball striking face, and a fourth adjustment point located approximately between the high-heel area and the high-toe area of the ball striking face.

According to other aspects of this invention, the club head may further comprise a second brace extending from the sole to the inner surface of the ball striking face, wherein the second brace applies a biasing force to the ball striking face. The second brace may further comprise a second ball-joint connection located adjacent to the ball striking face to connect the second brace to the ball striking face. The second brace may further comprise a second spring loaded member located adjacent to the sole. Additionally, the club head may further comprise a third brace extending from the sole to the inner surface of the ball striking face, wherein the third brace provides a biasing force to the ball striking face. The third brace may further comprise a second ball-joint connection located adjacent to the ball striking face to connect the third brace to the ball striking face. The third brace may further comprise a third spring loaded member located adjacent to the sole.

According to other aspects of this invention, the face angle of the club head is adjustable +/−3 degrees. In another example structure in accordance with this invention, the face angle of the club head is adjustable +/−1 degree. In another example structure in accordance with this invention, the loft angle of the club head is adjustable +/−5 degrees. In another example structure in accordance with this invention, the loft angle of the club head is adjustable +/−3 degrees. In another example structure in accordance with this invention, the loft angle of the club head is adjustable +/−1 degree.

According to further aspects of the invention, the golf club head may be part of a golf club. In such a configuration, a shaft may be connected to the head, such as by a hosel connected to or integrally formed as part of the head.

Other features and advantages of the invention will be apparent from the following specification taken in conjunction with the attached drawings.

BRIEF DESCRIPTION OF THE DRAWINGS

To allow for a more full understanding of the present invention, it will now be described by way of various examples, with reference to the accompanying drawings in which.

Figure 1:
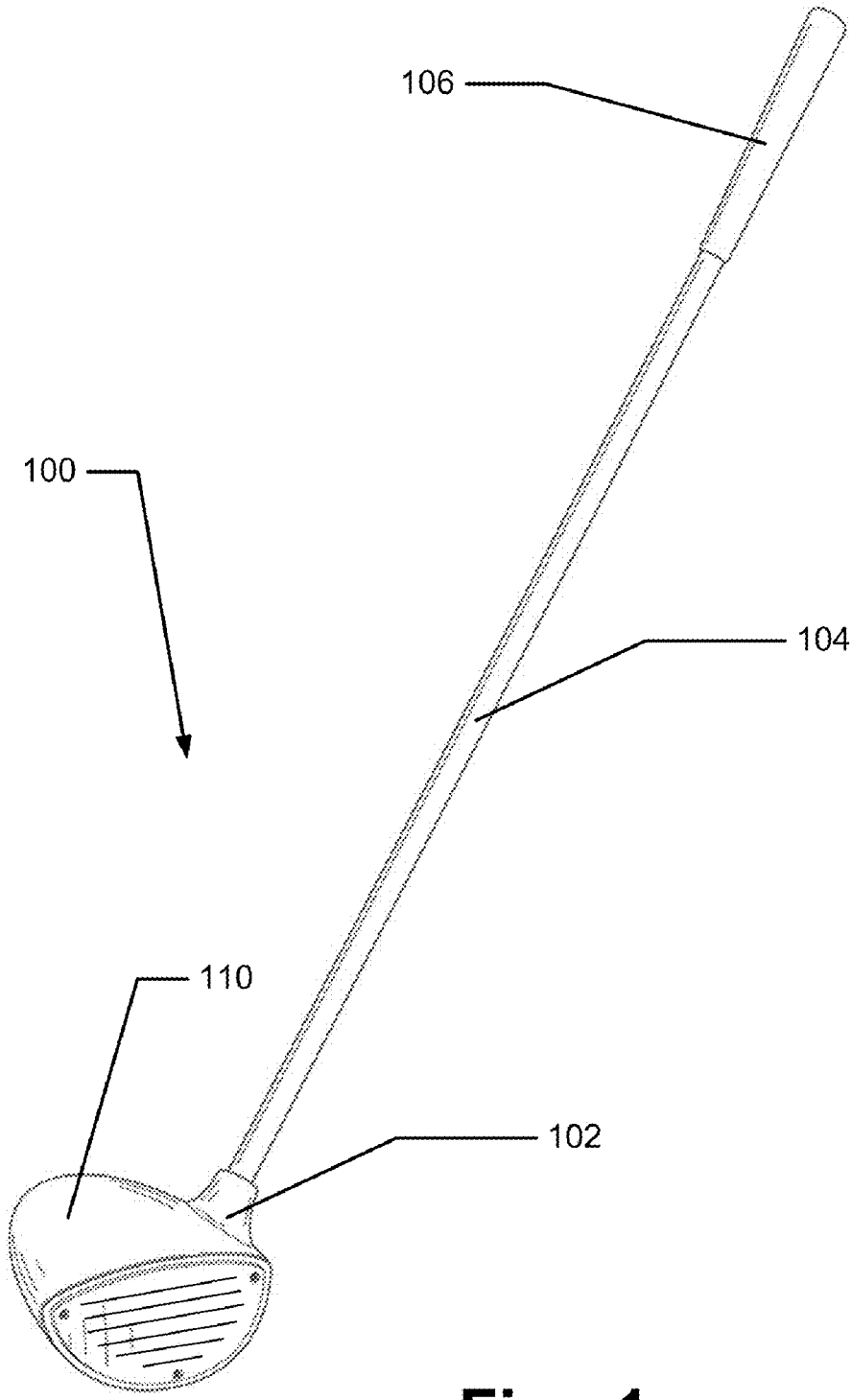
FIG. 1 illustrates a front perspective view of an example golf club according to this invention.

The reader is advised that the drawings included herewith are not necessarily drawn to scale, and in some instances, various lines, structures, or details may be omitted from the drawings so as not to obscure the various features being described.

DETAILED DESCRIPTION

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," "rear," and the like may be used in this specification to describe various example features and elements of the invention, these terms are used herein as a matter of convenience, e.g., based on the example orientations shown in the figures or the orientation during typical use. Additionally, the term "plurality," as used herein, indicates any number greater than one, either disjunctively or conjunctively, as necessary, up to an infinite number. Nothing in this specification should be construed as requiring a specific three dimensional orientation of structures in order to fall within the scope of this invention.

A. General Description of Aspects of this Invention

In general, aspects of this invention relate to golf clubs or golf club heads, and the like. Golf clubs, according to at least some examples of the invention, may include a golf club head and a ball striking surface. Some more specific aspects of this invention relate to wood-type golf clubs and golf club heads, including drivers, fairway woods, wood-type hybrid clubs, and the like, as well as iron-type golf clubs and golf club heads, including 1-irons through 9 irons, all types of wedges, iron-type hybrid clubs, and the like.

According to various aspects of this invention, the golf club head may be formed of one or more of a variety of materials, such as metals (including metal alloys, such as steels, titanium, titanium alloys, aluminum, aluminum alloys, etc.), ceramics, polymers, composites, fiber-reinforced composites, and wood. The golf clubs or golf club heads may be formed in one of a variety of configurations, without departing from the scope of the invention. In some examples, some or all components of the head, including the ball striking face and at least a portion of the body of the head, are made of metals or metal alloys. It is understood that the head may contain components made of several different materials. Additionally, the components may be formed by various forming methods. For example, metal components may be formed by forging, molding, casting, machining, and/or other known techniques. In other example structures, composite components, such as carbon fiber-polymer composites, can be included in the club head structure. Such components may be manufactured by a variety of composite processing techniques, such as prepreg processing, powder-based techniques, mold infiltration, and/or other known techniques. In general, aspects of this invention may be practiced with any desired materials, configured in any desired manners, including with conventional materials, configured and manufactured in conventional manners, as are known and used in the golf club art.

1. Wood-Type Golf Club Heads According to Examples of this Invention

More specific example aspects of this invention relate to wood-type golf clubs and golf club heads (e.g., drivers, fairway woods, wood-type hybrid clubs, etc.) that include: (a) a club head body having a front, a crown, a sole, and a face engaging area extending around the outer perimeter of the front of the club head body between the crown and the sole; (b) a face configured for striking a ball with an outer surface thereof, wherein the ball striking face is configured to engage the face engaging area; and (c) a brace extending from the sole to a contact point on an inner surface of the ball striking face, wherein the brace includes a biasing member such that the ball striking face is adjustable between a first direction thereby adjusting a face angle of the club head and a second direction thereby adjusting a loft angle of the club head.

Another example aspect of this invention relates to wood-type golf clubs and golf club heads (e.g., drivers, fairway woods, wood-type hybrid clubs, etc.) that include: (a) a club head body having a front, a crown, a sole, and a support rib extending around the outer perimeter of the front of the club head body between the crown and the sole; (b) a ball striking face configured for striking a ball with an outer surface thereof, wherein the ball striking face is configured to engage the support rib; (c) a brace extending from the sole to an inner surface of the ball striking face, wherein the brace includes: (1) an end portion engaged with the inner surface of the ball striking face, (2) a fixed rod located between the end portion and an inner surface of the club head at the sole, wherein the fixed rod also includes a retractable rod located within the fixed rod, and (3) a biasing member attached to the retractable rod, wherein the biasing member surrounds at least a portion of the fixed rod and provides a biasing force to the ball striking face such that the ball striking face is adjustable between a first direction thereby adjusting a face angle of the club head and a second direction thereby adjusting a loft angle of the club head.

2. Additional Potential Features of Golf Club Heads According to Examples of this Invention In some example structures in accordance with this invention, the club head body and the face engaging area may comprise a support rib configured to engage the ball striking face when the ball striking face is attached to the club head. Additionally, the club head body and the ball striking face may comprise a plurality of support blocks configured to engage the ball striking face when the ball striking face is attached to the club head. Additionally, the club head body and the ball striking face may define a cavity, wherein the brace may extend through a portion of the cavity between the sole and the ball striking face.

In other example structures in accordance with this invention, the brace may further include a ball-joint connection located adjacent to the contact point or end portion to connect the brace to the ball striking face. Additionally the biasing member of the brace may maintain a constant force applied to the ball striking face when the ball striking face is adjusted between the first direction and the second direction. The biasing member may comprise a spring loaded member located adjacent to the sole.

In other example structures in accordance with this invention, the ball striking face may further include a plurality of adjustment points. Each of the plurality of adjustment points may comprise a screw that engages the ball striking face to the face engaging area. In one configuration, the plurality of adjustment points may include a first adjustment point located approximately at a high-heel area of the ball striking face, a second adjustment point located approximately at a high-toe area of the ball striking face, and a third adjustment point located approximately between a low-heel area and a low-toe area of the ball striking face. In a second configuration, the plurality of adjustment points may include a first adjustment point located approximately at a high-heel area of the ball striking face, a second adjustment point located approximately at a high-toe area of the ball striking face, a third adjustment point located approximately between a low-heel area and a low-toe area of the ball striking face, and a fourth adjustment point located approximately between the high-heel area and the high-toe area of the ball striking face.

In other example structures in accordance with this invention, the club head may further comprise a second brace extending from the sole to the inner surface of the ball striking face, wherein the second brace applies a biasing force to the ball striking face. The second brace may further comprises a second ball-joint connection located adjacent to the ball striking face to connect the second brace to the ball striking face. The second brace may further comprise a second spring loaded member located adjacent to the sole. Additionally, the club head may further comprise a third brace extending from the sole to the inner surface of the ball striking face, wherein the third brace provides a biasing force to the ball striking face. The third brace may further comprise a second ball-joint connection located adjacent to the ball striking face to connect the third brace to the ball striking face. The third brace may further comprise a third spring loaded member located adjacent to the sole.

In other example structures in accordance with this invention, the face angle of the club head is adjustable +/−3 degrees. In another example structure in accordance with this invention, the face angle of the club head is adjustable +/−1 degree. In another example structure in accordance with this invention, the loft angle of the club head is adjustable +/−5 degrees. In another example structure in accordance with this invention, the loft angle of the club head is adjustable +/−3 degrees. In another example structure in accordance with this invention, the loft angle of the club head is adjustable +/−1 degree.

Additional aspects of this invention relate to methods of producing golf club heads having braces of the types described above (and described in more detail below) and methods of controlling and customizing the flexibility of a golf club face using braces of the types described above (and described in more detail below). Still additional aspects of this invention include golf clubs and methods of making golf clubs, including heads of the types described above.

Given this general description of various aspects of this invention, a more detailed description of specific example structures in accordance with this invention will be provided below.

C. Detailed Description of Examples of this Invention

The various figures in this application illustrate examples of golf clubs and golf club heads according to this invention.

When the same reference number appears in more than one drawing, that reference number is used consistently in this specification and the drawings to refer to the same or similar parts throughout.

At least some examples of golf clubs according to this invention relate to golf club head structures, including heads for wood-type and iron-type golf clubs. Such heads may include a one-piece construction or a multiple-piece construction. An example structure of a "wood-type" golf club head according to this invention will be described in detail below in conjunction with FIGS. 1 through 12, and it will be referred to generally using reference numeral "110." As is known in the art, "wood-type" golf club heads may be made from any desired materials, including any of the various materials noted above.

FIG. 1 illustrates an example of a golf club 100, in accordance with at least some examples of this invention. As is conventional, the golf club 100 includes a club head 110, a hosel 102 that connects the club head 110 to a shaft 104, and a grip member 106 engaged with the shaft 104. Various example features and aspects of the club head structure 110 will be described below in conjunction with the remaining figures.

As illustrated in FIG. 1, the club head 110 may be engaged with the shaft 104 via the hosel 102 in any desired manner, including manners that are known and used in the art (e.g., via cements or adhesives, via mechanical connections, via releasable mechanical connections, via welding, soldering, brazing, or other fusing techniques, etc.). Any desired material may be used for the shaft member 104, including conventional materials that are known and used in the art, such as steel, graphite, polymers, composite materials, combinations of these materials, etc. Likewise, the grip member 106 may be engaged with the shaft 104 in any desired manner, including in manners that are known and used in the art (e.g., via cements and adhesives, via mechanical connectors, via releasable mechanical connections, etc.). Any desired material may be used for the grip member 106, including conventional materials that are known and used in the art, such as rubber, polymeric materials, cork, rubber or polymeric materials with cord or other fabric elements embedded therein, cloth or fabric, tape, etc.

The golf club heads 110 shown in FIGS. 2A through 12 contain many common features, which are referenced by similar reference numerals in the description below. As shown in FIGS. 2A-5, the club head 110 generally includes a ball striking face 112, a club head body 114, and at least one brace 140. The at least one brace 140 may be attached to or engaged with the ball striking face 112 and/or the club head body 114. The brace 140 may provide support to the ball striking face 112 such that the ball striking face 112 may be adjusted left or right (for hook and slice) or up and down (for loft and de-loft). This adjustability feature may allow a golfer to adjust the direction of the ball upon impact by adjusting the angle and orientation of the ball striking face 112 which strikes the ball.

The club head 110 may generally have a top or crown 116, a bottom or sole 118, a heel 120 proximate the hosel 102, a toe 122 distal from the hosel 102, a front 124, and a rear 126. The shape and design of the club head 110 and the club head body 114 may be partially dictated by the intended use of the golf club 100. In the golf club head 110 shown in FIGS. 1 through 12, the head 110 has a relatively large volume, as the golf club head 110 is designed for use as a driver or other wood-type golf club, intended to hit the ball accurately over long distances. In other applications, such as for different types of golf clubs, the head may be designed to have different dimensions and configurations. When configured as a driver, the club head 110 may have a volume of at least 400 cc, and in some structures, at least 450 cc, or even at least 460 cc. Other appropriate sizes and constructions for other club heads may be readily determined by those skilled in the art.

In the example golf club head 110 illustrated in FIGS. 2A through 5, the club head 110 has a hollow structure defining an inner cavity 128 (e.g., defined by the ball striking face 112 and the body 114). Thus, the club head 110 has a plurality of inner surfaces defined therein. The inner surfaces include an inner face surface 130 (i.e., the rear side of the ball striking face 112) and a plurality of inner body surfaces 136. As illustrated in FIG. 4A, the hollow center cavity 128 may be filled with air (or another gas). However, in other example structures, the head 110 could be filled or partially filled with another material, such as a foam material. In still further examples, the solid materials of the head 110 may occupy a greater proportion of the volume, and the head 110 may have a smaller interior cavity 128 or no inner cavity or open space at all. It is understood that the inner cavity 128 may not be completely enclosed in some embodiments.

Additionally, the golf club head 110 may include a face engaging area. In an example according to aspects of this invention, as illustrated in FIGS. 3A through 5, the face engaging area may include a plurality of support blocks 161 162 163. The support blocks 161 162 163 may be engaged with or attached to the inner body surfaces 136 and extend from the perimeter of the club head inner body surfaces 136. The support blocks 161 162 163 may be configured to support the ball striking face 112, when the ball striking face 112 is attached to the club head body 114. Additionally, as described more below, the support blocks 161 162 163 may include attachment means for the ball striking face 112, such as screw holes, etc. The support blocks 161 162 163 may be manufactured as an integral component to the club head body in accordance with aspects of this invention. In another embodiment in accordance with this invention, the support blocks 161 162 163 may also be manufactured as separate parts that may be attached to the club head body 114. The support blocks 161 162 163 may be attached to the club head body 114 in any one of various "engaging" techniques known and used in the art, such as: bonding using adhesives or cements; engaging using welding, brazing soldering, or other fusing techniques; attachment using mechanical connectors including user releasable connectors (such as screws, bolts, nuts, or the like); and the like. The support blocks 161 162 163 may include one or more metal alloys.

As illustrated in FIG. 2A through FIG. 5, the ball striking face 112 is located at the front 124 of the club head 110, and has a ball striking surface 113 located thereon. The ball striking surface 113 is configured to face and contact a ball in use, and it is adapted to strike the ball when the golf club 100 is set in motion, such as by swinging. As shown, the ball striking surface 113 may be relatively flat, occupying most of the ball striking face 112. For reference purposes, the portion of the ball striking face 112 near the top or crown 116 and the heel 120 of the club head 110 is referred to herein as the "high-heel area"; the portion of the ball striking face 112 near the top or crown 116 and toe 122 of the club head 110 is referred to herein as the "high-toe area"; the portion of the ball striking face 112 near the bottom or sole 118 and heel 120 of the club head 110 is referred to herein as the "low-heel area"; and the portion of the ball striking face 112 near the bottom or sole 118 and toe 122 of the club head 110 is referred to herein as the "low-toe area." The ball striking face 112 may include some curvature in the top to bottom and/or heel to toe directions (e.g., bulge and roll radii), as is known and is conventional in the art. In the embodiment shown, the ball striking surface 113 is inclined slightly with respect to the general plane of the sole 118 (i.e., to provide a loft angle), to give the ball slight lift and spin when struck. In other embodiments, the ball striking surface 113 may have different inclines or loft angles, grooves, and/or other structures, e.g., to affect the trajectory or spin of the ball when propelled. Additionally, the ball striking face 112 may have a variable thickness in some embodiments.

Figure 2A:
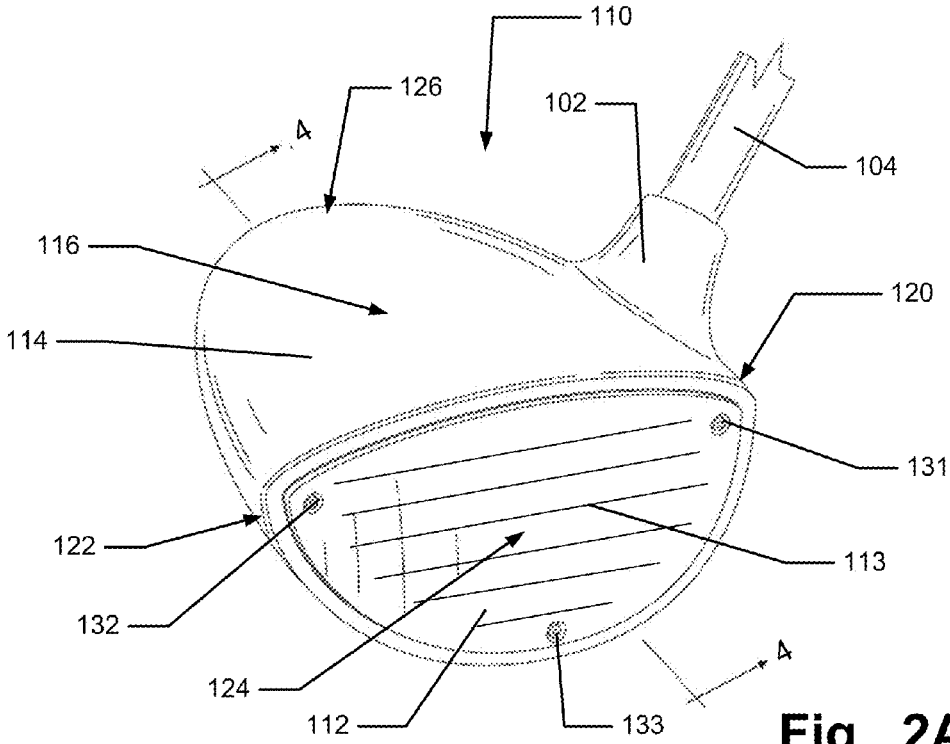
FIG. 2A illustrates a front perspective view of the golf club head of FIG. 1 according to this invention.
Figure 2B:
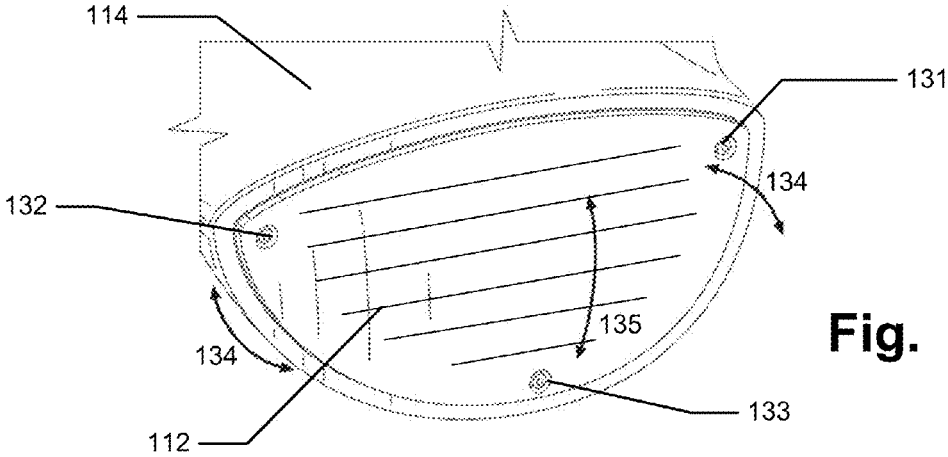
FIG. 2B illustrates a partial close-up front perspective view of the golf club head of FIG. 2A according to this invention.
Figure 3A:
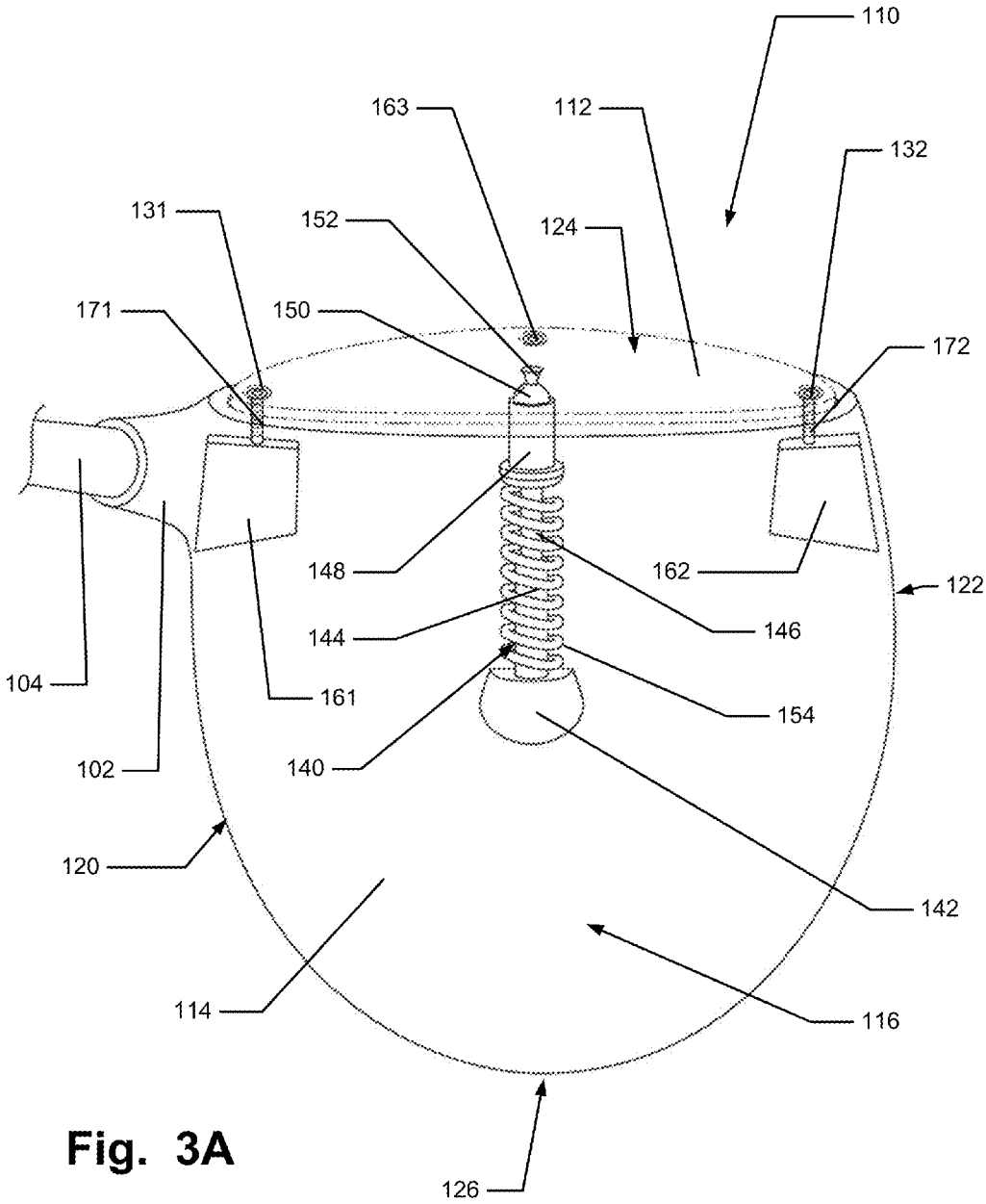
FIG. 3A illustrates a top view of the golf club head of FIG. 2A according to this invention and showing certain internal structures of the golf club head.
Figure 3B:
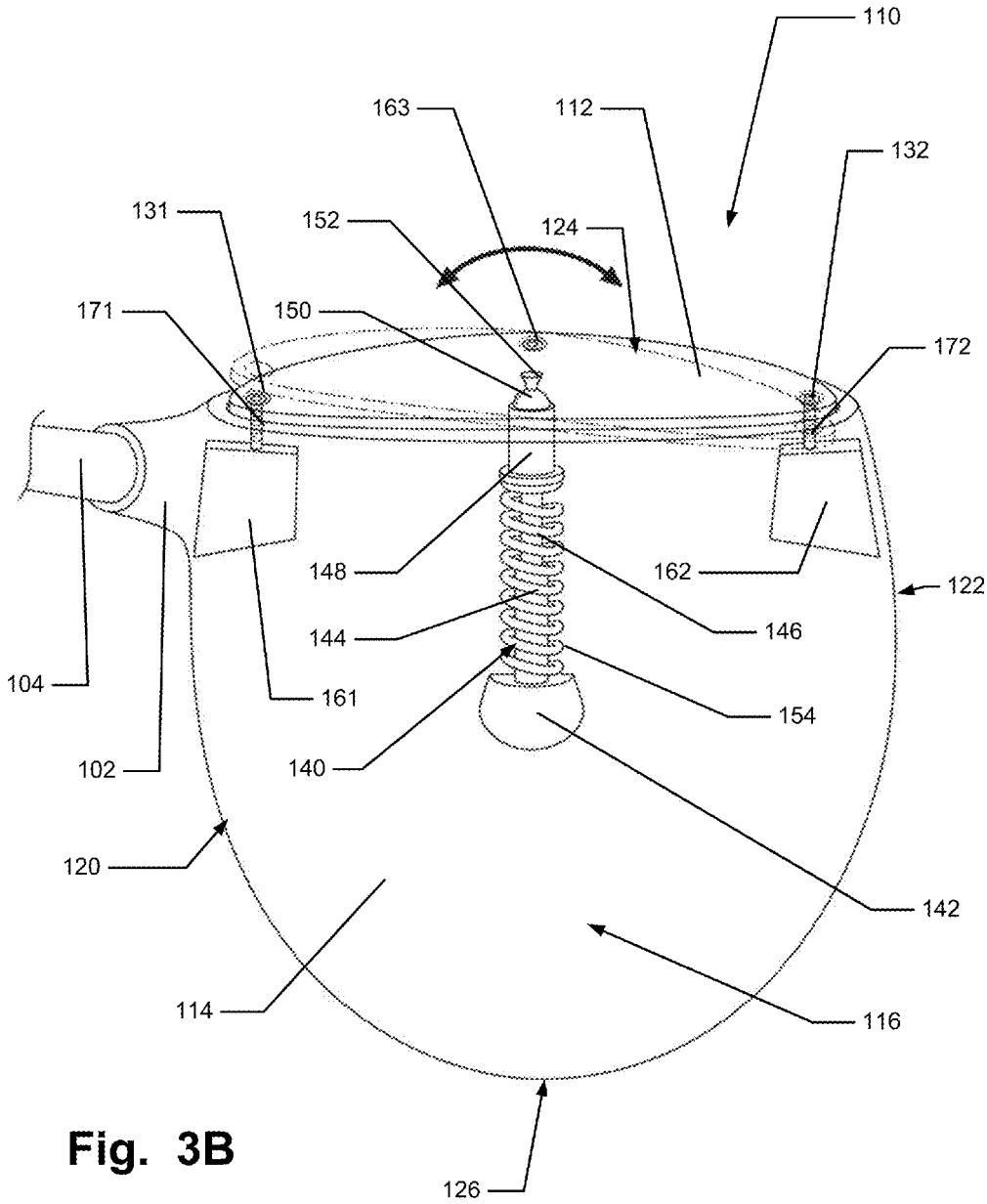
FIG. 3B illustrates a top view of the golf club head of FIG. 3A showing the movement of the ball striking face according to this invention.

In the illustrated embodiment shown in FIGS. 2A and 2B, the ball striking face 112 of a given club head 110 has a face angle. The face angle is the angle of the ball striking face 112 of the club head 110 relative to the target. If the club head 110 is "square" or with a face angle at zero degrees, the ball striking face 112 will be directly facing the target on address. FIG. 3A illustrates a ball striking face 112 of the club head that has a "square" face angle. If the club head 110 is "closed" or with a face angle of minus degrees, the ball striking face 112 will be aligned to the left of the target (for right-handed players; the opposite is true for left-handed players). If the club head 110 is "open" or with a face angle of positive degrees, the ball striking face 112 will be aligned to the right of the target (for right-handed players; the opposite is true for left-handed players). As will be discussed further below, the face angle of the ball striking face 112 of the present invention may be adjusted in accordance with this invention. For example, in accordance with at least some examples of the invention, the face angle of the ball striking face 112 may be adjusted (either positive or minus) by at least approximately 1 degree. In another embodiment in accordance with at least some examples of the invention, the face angle of the ball striking face 112 may be adjusted (either positive or minus) by at least approximately 3 degrees. In another embodiment in accordance with at least some examples of the invention, the face angle of the ball striking face 112 may be adjusted (either positive or minus) by at least approximately 5 degrees. FIG. 3B illustrates an example club head 110 with the ball striking face 112 adjusted for face angle, specifically, with the ball striking face 112 with an open, or positive face angle.

Figure 4A:
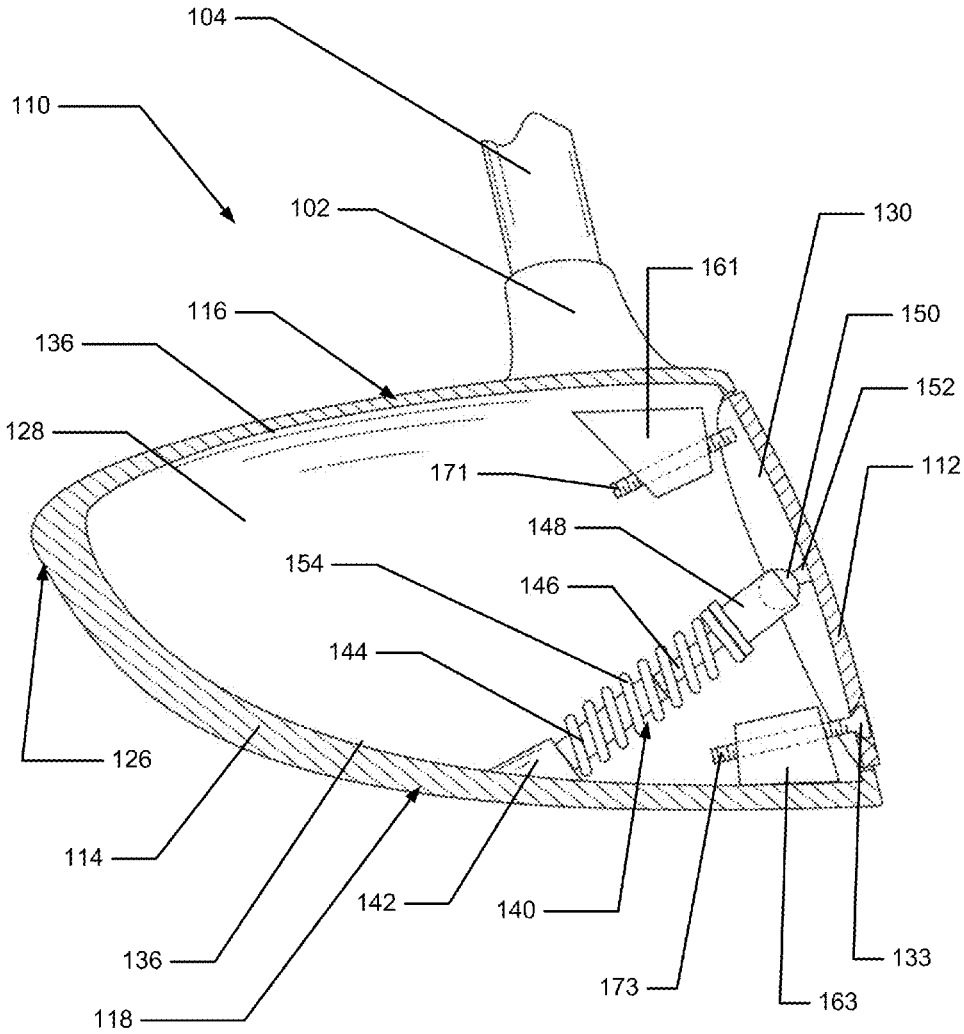
FIG. 4A illustrates a cross-sectional view of the golf club head of FIG. 2A taken along line 4-4 in FIG. 2A according to this invention.
Figure 4B:
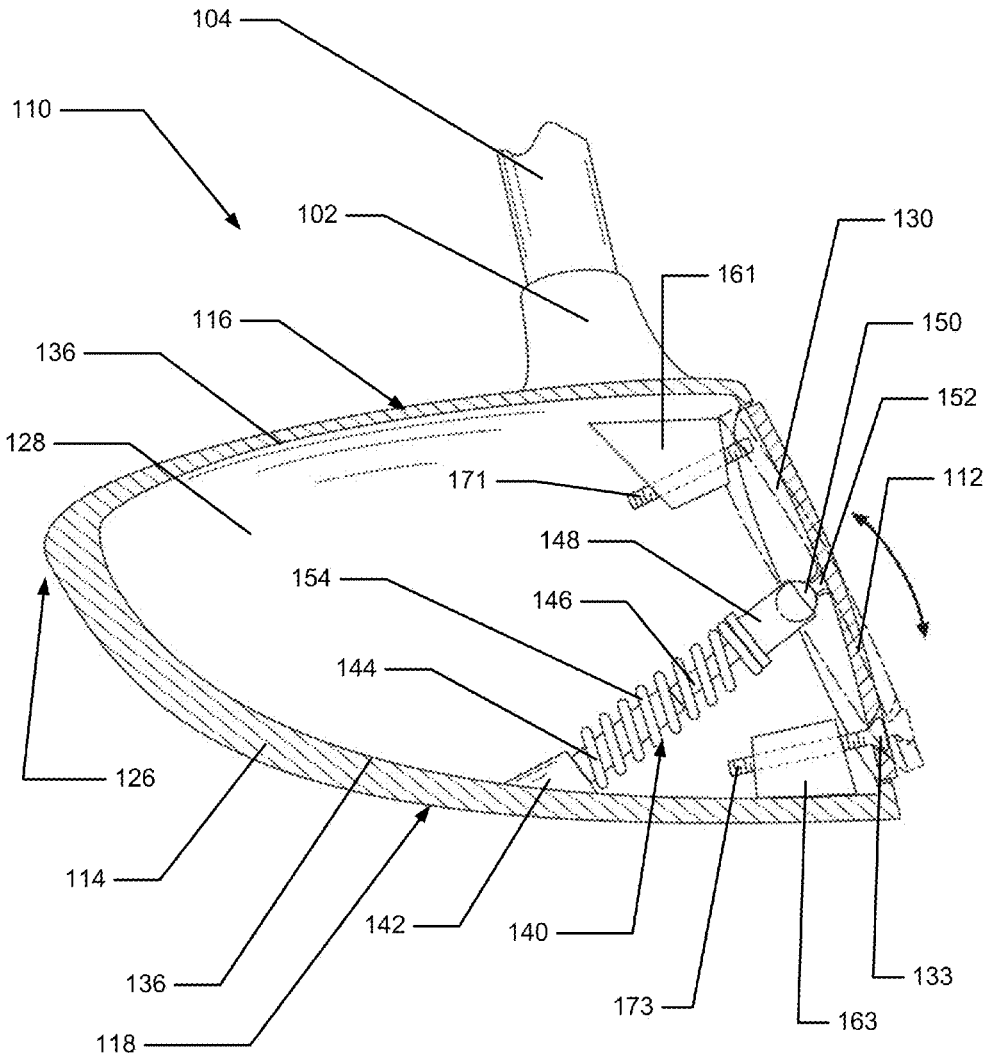
FIG. 4B illustrates a cross-sectional view of the golf club head of FIG. 4A showing the movement of the ball striking face according to this invention.

Additionally, in the illustrative embodiment shown in FIGS. 2A and 2B, the ball striking surface 113 is inclined slightly (i.e., at a loft angle), to give a golf ball slight lift and spin when struck. Generally, the loft angle is the main determining factor in golf ball trajectory. FIG. 4A illustrates the ball striking face 112 with a loft angle with no adjustments. The loft angle of a ball striking face 112 can be varied to effect the trajectory, distance, backspin, and roll of a golf ball struck by a club head 110. As will be discussed further below, the loft angle of the ball striking face 112 of the present invention may be adjusted in accordance with this invention. For example, in accordance with at least some examples of the invention, the loft angle of the club head 110 may be adjusted (increased or decreased) by at least approximately 2 degrees. In another embodiment in accordance with at least some examples of the invention, the loft angle of the club head 110 may be adjusted (increased or decreased) by at least approximately 4 degrees. In another embodiment in accordance with at least some examples of the invention, the loft angle of the club head 110 may be adjusted (increased or decreased) by at least approximately 6 degrees. FIG. 4B illustrates an example club head 110 with the ball striking face 112 adjusted for loft angle, specifically, increasing the loft angle.

Additionally, the face angle and the loft angle of the ball striking face 112 may be adjusted in combination together. For example, the face angle may be adjusted with an open or positive face angle and the loft angle may be increased in combination with each other. In another example, the face angle may be adjusted with a closed or negative face angle and the loft angle may be decreased in combination with each other. Any combination of the face angle and the loft angle of the ball striking face 112 may be utilized without departing from this invention.

As illustrated in FIGS. 2A and 2B, the ball striking face 112 may include a plurality of adjustment points 131 132 133 which may allow a user or club fitter to adjust the loft angle and face angle. Each adjustment point may include a screw 171 172 173 and a corresponding screw hole 171A 172A 173A located in the ball striking face 112. In accordance with other examples of this invention, the adjustment point 131 132 133 may include additional or different means of adjusting the loft angle and face angle as presently known in the art, such as set screws, bolts, or other mechanical connectors as known and used in the art. Additionally, these set screws, bolts, or other mechanical connectors may include female heads such as known and used in the art, for example Phillips heads or star-torque heads, etc. As specifically illustrated in the example club head 110 in accordance with this invention in FIG. 2A, the ball striking face 112 includes a first adjustment point 131, a second adjustment point 132, and a third adjustment point 133. The first adjustment point 131 may be located approximately at the high-heel area 122 of the ball striking face 112. The second adjustment point 132 may be located approximately at the high-toe area 120 of the ball striking face 112. The third adjustment point 133 may be located approximately between the low-heel area 122 and the low-toe area 120 of the ball striking face 112.

As illustrated in the embodiment of the golf club heads 110 shown in FIGS. 3A through 5, the club head 110 may also include a brace system or brace 140. The brace 140 could also be identified or referenced as a support member. In this example golf club head 110, the brace 140 may extend from an inner surface 136 of the club head body 110, across at least a portion of the cavity 128, to the inner surface 130 of the ball striking face 112. In the example golf club head 110 illustrated in FIG. 4A, the brace 140 extends from the sole of the club head body 114 to the inner surface 130 of the ball striking face 112. In other structures, the brace 140 may extend from a different one of the inner surfaces 136 of the body 114, for example, from the top 116 to the inner surface 130 of the ball striking face 112. The golf club head 110 need not have an inner cavity, or the inner cavity 128 may be filled with another material, and the brace 140 may extend across or through a solid material or a filler material between the inner body surface 136 and the ball striking face 112.

The brace 140 may extend to and contact the sole 118 or top 116 of the golf club head 110 at any desired position without departing from this invention, provided the brace 140 is positioned and oriented (or angled) to provide the desired supporting or bracing and adjustable functions. The brace 140 may extend to and contact the sole 118 by being integrally formed or contacted with the sole 118. In another embodiment in accordance with this invention, the brace may extend to and contact the sole 118 at a sole engagement portion 142. The sole engagement portion 142, as illustrated in FIG. 4A, may be attached to the sole 118 or top 116 of the golf club head 110. Additionally the sole engagement portion 142 may provide the brace 140 an engagement area to contact the sole 118 or top 116 of the club head 110. The sole engagement portion 142 may include a receptacle to receive the brace 140. Additionally, the sole engagement portion 142 may include other attachment means known and used in the art.

Figure 9:
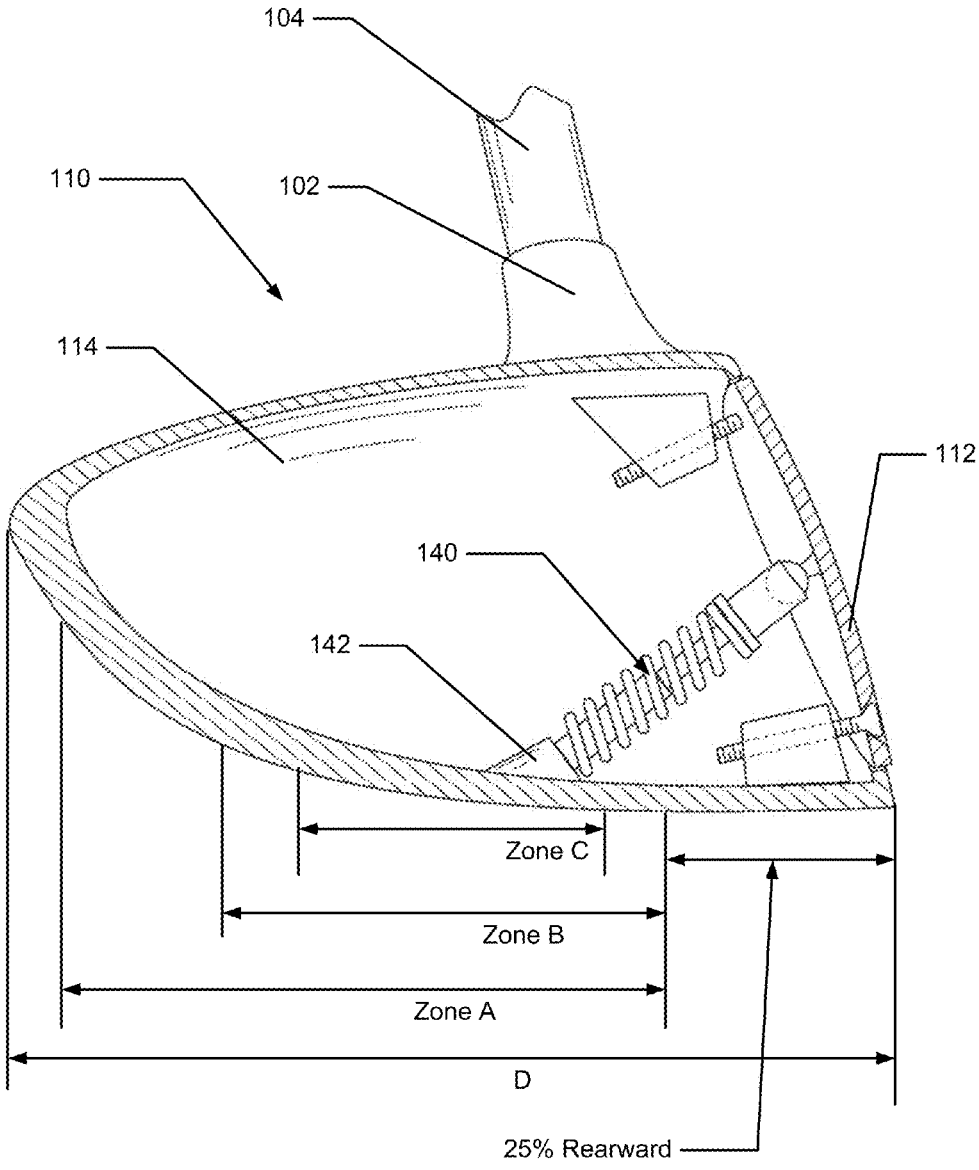
FIG. 9 illustrates a cross-sectional view of the golf club head of FIG. 2A taken along line 4-4 in FIG. 2A according to this invention.

As some more specific examples, as illustrated in FIG. 9, the brace 140 may intersect with or contact the sole 118 or top 116 at a location rearward from the ball striking face 112 within a range of 25% to 95% of its overall depth D in the front to rear direction (Zone A in FIG. 9), and in some examples, within 25% to 75% of the overall depth (Zone B in FIG. 9), or even within 30% to 65% of the overall depth (Zone C in FIG. 9). For driver structures, the brace 140 may intersect with or contact the sole 118 or top 116 at a location between 1.25 and 4.75 inches from the ball striking face 112, and in some examples, within 1.25 to 3.75 inches from the ball striking face 112, or even within 1.5 to 3.25 inches from the ball striking face 112.

In the golf club head 110 shown in FIGS. 3A through 4B, the brace 140 may include a fixed rod 144, an end portion 152, and a biasing member 154. The end portion 152 may be connected to or engaged with the inner face surface 130 to form a contact point between the brace 140 and the ball striking face 112. The fixed rod 144 may be located between the end portion 152 and the inner surface 136 of the club head 110, with the biasing member 154 surrounded outside a portion of or the entire fixed rod 144. In an alternate embodiment in accordance with this invention, the fixed rod 144 may be located between the end portion 152 and the biasing member 154. The biasing member 154 may provide a biasing force to the ball striking face 112 such that the ball striking face 112 may be adjustable to a user.

Furthermore, the fixed rod 144 may also include a retractable rod 146 located within or extending from the fixed rod 144. The retractable rod 146 may be attached to the biasing member 154 such that the retractable rod 146 may retract into the fixed rod 144 when pressure is placed against the ball striking face 112 (such as when a ball contacts the ball striking face 112). The fixed rod 144 and the retractable rod 146 may be made of materials known and used in the art, such as metals or plastics, etc. The fixed rod 144 and the retractable rod 146 may have different cross-sectional shapes, such as circular, oval, or rectangular in accordance with this invention.

Additionally, the end portion 152 or contact point may include a ball-joint connection engaged with the end portion 152 that contains a mating male ball-joint 150. The ball-joint connection may provide additional support when the ball striking face 112 is adjusted. The end portion 152 may also include a ball support member 148. The ball support member 148 may be engaged with one or more of the biasing member 154, the fixed rod 144, or the retractable rod 146. Additionally, the ball joint 150 may be engaged with the ball support member 148. The ball joint 150 may be engaged such that as the ball striking face 112 is adjusted up or down and/or left or right, the ball joint 150 pivots to allow the club head 110 loft angle and/or face angle to be adjusted. The ball joint 150 allows movement of the ball striking face 112 in a plurality of directions. Additionally, the ball joint 150 may be engaged with the end portion 152 that is engaged with or connected to the ball striking face 112.

The end portion 152 or the contact point may have any desired sizes without departing from the invention, e.g., to produce the localized stiffness features described above. As some more specific examples, the end portion 152 may cover an area of the inner surface 130 of the ball striking face 112 of at least 0.1 square inches, or even within the range of 0.1 square inches to 3 square inches. In other examples, this area of the end portion 152 may be in the range of 0.25 square inches to 2.5 square inches, or even in the range of 0.5 square inches to 1.75 square inches. The end portion 152 also may be positioned at any desired location on the ball striking face 112 without departing from this invention. Similarly, the brace 140 may be sized and positioned with respect to the ball striking face 112 and the club head body 114 such that it extends rearward from the ball striking face 112 and makes any desired angle with respect to the ball striking face 112.

The example golf club 100 illustrated in FIGS. 3A through 4B may also include a biasing member 154. The biasing member 154 may be located at any point along the fixed rod 144 and/or the retractable rod 146. In the example as shown in FIGS. 3A through 4B, the biasing member 154 is located adjacent to the location where the fixed rod 144 is connected to the sole 118. The biasing member 154 may consist of a mechanical spring, shock absorber or any other dynamic structure or similar type device capable of providing a biasing force against the ball striking face 112. Additionally, the biasing member 154 may be formed of one or more of a variety of materials, such as metals (including metal alloys, such as steels, titanium, titanium alloys, aluminum, aluminum alloys, etc.), ceramics, polymers, composites, or fiber-reinforced composites. The biasing member 154 may provide a biasing force to the ball striking face 112 such that the ball striking face 112 may be adjustable. As shown in FIG. 2B, the biasing member 154 may allow the ball striking face 112 to be adjustable in at least two directions, a first direction 134 and a second direction 135. The first direction 134 may be a left or right direction, which may adjust the face angle of the club head 110. By adjusting the face angle, the club head 110 may be configured to either hook or slice a golf ball. The second direction 135 may be an up or down direction, which may adjust the loft angle of the club head 110. By adjusting the loft angle, the club head 110 may be configured to either loft or deloft the ball striking face, thereby causing the golf ball to either go higher or lower, respectively.

The brace 140 may be made from any desired materials and/or any desired number of separate parts without departing from this invention. For example, the brace 140 (or at least some portions thereof) may be made from a relatively stiff or rigid material, like metals (e.g., titanium, aluminum, steel, or other metal materials (including alloys) conventionally used in golf club construction), polymers, ceramics, etc. The brace 140 also may be sized and constructed such that the majority of its weight is located toward the sole engagement portion 142, to help keep a low overall center of gravity for the club head 110.

While the invention has been described above in conjunction with wood-type golf clubs and golf club heads (including drivers), aspects of this invention are not limited to such clubs. Rather, the various aspects and features of this invention may be applied for use in iron-type golf clubs and golf club heads.

It is understood that the ball striking faces of the various club head structures described herein may have additional features affecting the flexibility of the ball striking face or areas thereof For example, the ball striking faces may have areas of relatively increased or decreased thickness. Additionally, the heads described herein may contain more than one brace, optionally, creating multiple areas of relative stiffness and flexibility.

The heads disclosed herein may be used as a golf club or a part thereof For example, a wood-type golf club 100 as shown in FIG. 1 or an iron-type golf club may be manufactured by attaching a shaft or handle 104 to the head 110, as described above. Such shaft attachments may be accomplished in conventional manners that are known and used in the art, including with releasable golf club head and shaft connection assemblies. In other embodiments, different types of golf clubs can be manufactured according to the principles described herein.

Figure 5:
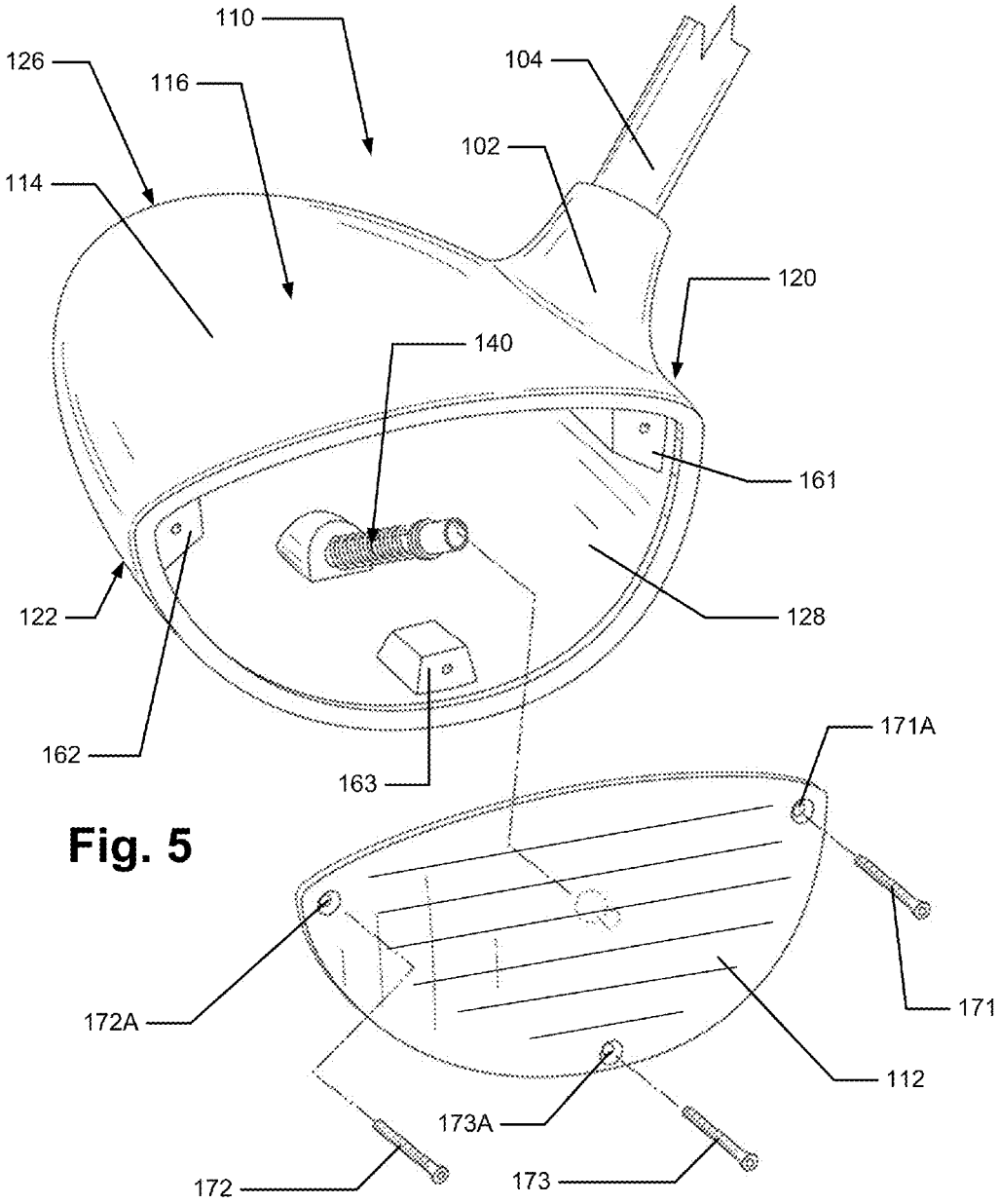
FIG. 5 illustrates a front perspective exploded view of the golf club head of FIG. 2A according to this invention.

The golf club heads of the present invention include the feature of adjusting the loft angle and/or the face angle of the club head. Referring to FIGS. 2A and 5, a user may adjust the ball striking face 112 by adjusting one or more of the plurality of adjustment points 131 132 133 on the club head 110. In one example, the user may want to adjust the ball striking face 112 to be more lofted or increase the loft angle of the club head 110. In this example, the user may rotate the bottom screw 173 counterclockwise, thereby loosening the screw 173 from the support block 163 and the club head body 114. This loosening action will allow the bottom of the ball striking face 112 to move outward away from the club head body 114, thereby increasing the loft angle of the club head 110. FIG. 4B illustrates a club head 110 with a ball striking face 112 with an increased loft angle. Additionally, the user may rotate both of the upper face screws 171 172 clockwise, thereby tightening the screws 171 172 into the support blocks 161 162 and the club head body 114. This tightening action will allow the top of the ball striking face 112 to move inward toward the club head body 114, thereby also increasing the loft angle of the club head 110. During these actions, the brace 140, along with the biasing member 154, provides an outward biasing force to maintain the ball striking face 112 in the correct position along the club head body 114. FIG. 4B illustrates a club head 110 with a ball striking face 112 with an increased loft angle.

In another example in accordance with this invention, the user may want to adjust the ball striking face 112 to be de-lofted or decrease the loft angle of the club head 110. In this example, the user may rotate both of the upper face screws 171 172 counterclockwise, thereby loosening the screws 171 172 from the support blocks 161 162 and the club head body 114. This loosening action will allow the top of the ball striking face 112 to move outward from the club head body 114, thereby decreasing the loft angle of the club head 110. Additionally, the user may rotate the bottom screw 173 clockwise, thereby tightening the screw 173 into the support block 163 and the club head body 114. This tightening action will allow the bottom of the ball striking face 112 to move inward toward the club head body 114, thereby also decreasing the loft angle of the club head 110. During these actions, the brace 140, along with the biasing member 154, provides an outward biasing force to maintain the ball striking face 112 in the correct position along the club head body 114.

In another example in accordance with this invention, the user may want to adjust the ball striking face 112 to be closed and adjust the face angle of the club head 110. In this example, the user may rotate the high-toe screw 172 counterclockwise, thereby loosening the screw 172 from the support block 162 and the club head body 114. This loosening action will allow the toe side of the ball striking face 112 to move outward away from the club head body 114, thereby closing the face angle of the club head 110. Additionally, the user may rotate the high-heel screw 171 clockwise, thereby tightening the screw 171 into the support block 161 and the club head body 114. This tightening action will allow the heel side of the ball striking face 112 to move inward toward the club head body 114, thereby closing the face angle of the club head 110. During these actions, the brace 140, along with the biasing member 154, provides an outward biasing force to maintain the ball striking face 112 in the correct position along the club head body 114.

In yet another example in accordance with this invention, the user may want to adjust the ball striking face 112 to be open and adjust the face angle of the club head 110. In this example, the user may rotate the high-heel screw 171 counterclockwise, thereby loosening the screw 171 from the support block 161 and the club head body 114. This loosening action will allow the heel side 122 of the ball striking face 112 to move outward away from the club head body 114, thereby opening the face angle of the club head 110. Additionally, the user may rotate the high-toe screw 172 clockwise, thereby tightening the screw 172 into the support block 162 and the club head body 114. This tightening action will allow the toe side 120 of the ball striking face 112 to move inward toward the club head body 114, thereby opening the face angle of the club head 110. During these actions, the brace 140, along with the biasing member 154, provides an outward biasing force to maintain the ball striking face 112 in the correct position along the club head body 114. FIG. 3B illustrates a club head 110 with a ball striking face 112 with an open or positive face angle.

Additionally, the face angle and the loft angle of the ball striking face 112 may be adjusted in combination together. For example, the face angle may be adjusted with an open or positive face angle and the loft angle may be increased in combination with each other. In another example, the face angle may be adjusted with a closed or negative face angle and the loft angle may be decreased in combination with each other. Any combination of the face angle and the loft angle of the ball striking face 112 may be utilized without departing from this invention. These adjustments may be completed by adjusting both the loft angle as described above and the face angle as described above.

Figure 6A:
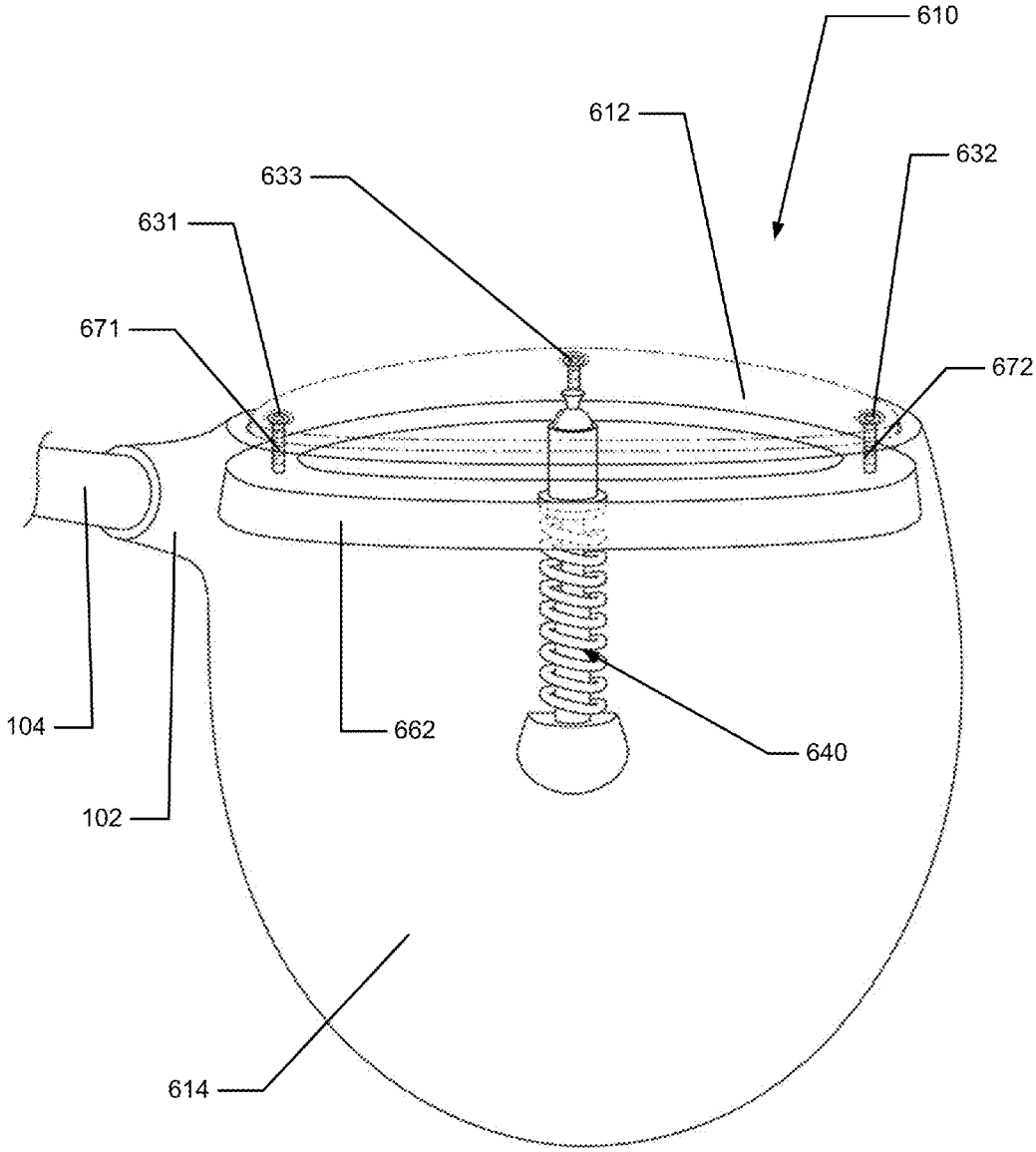
FIGS. 6A through 6C illustrate examples of another golf club head in accordance with at least some examples of this invention.
Figure 6B:
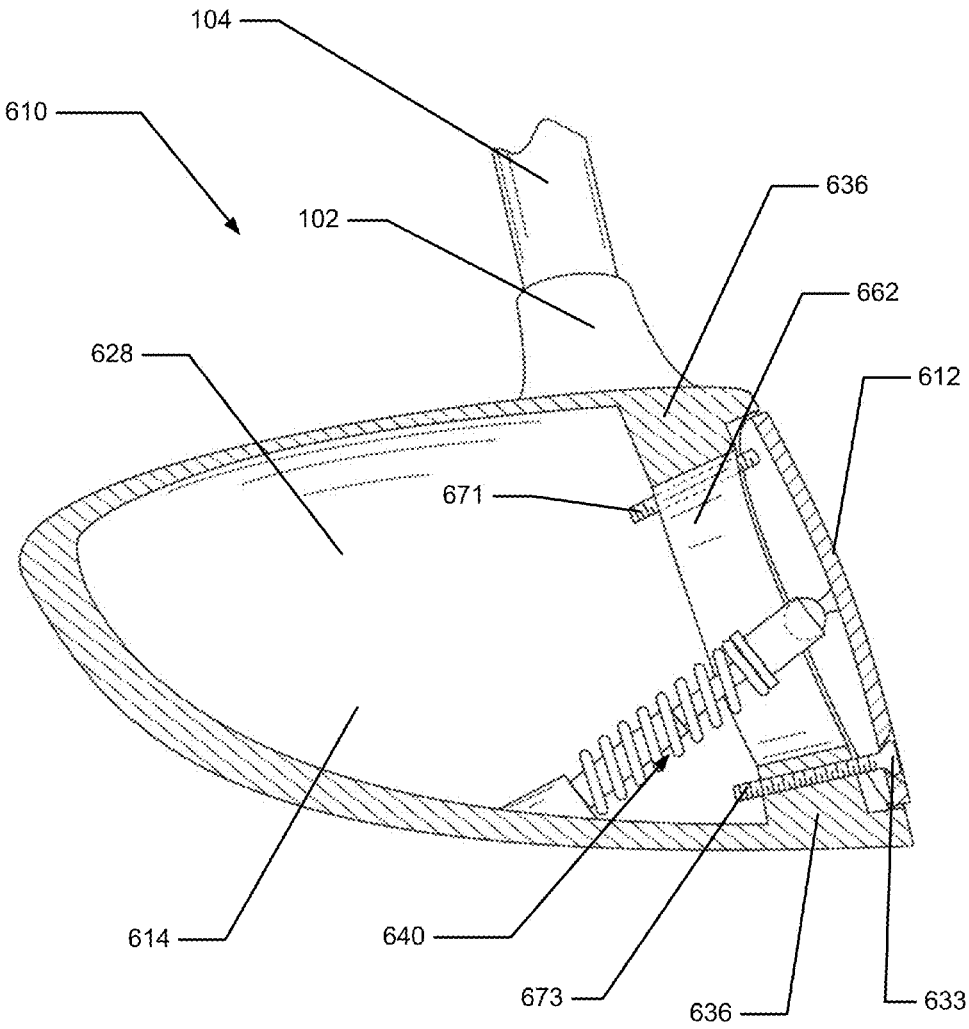
Figure 6C:
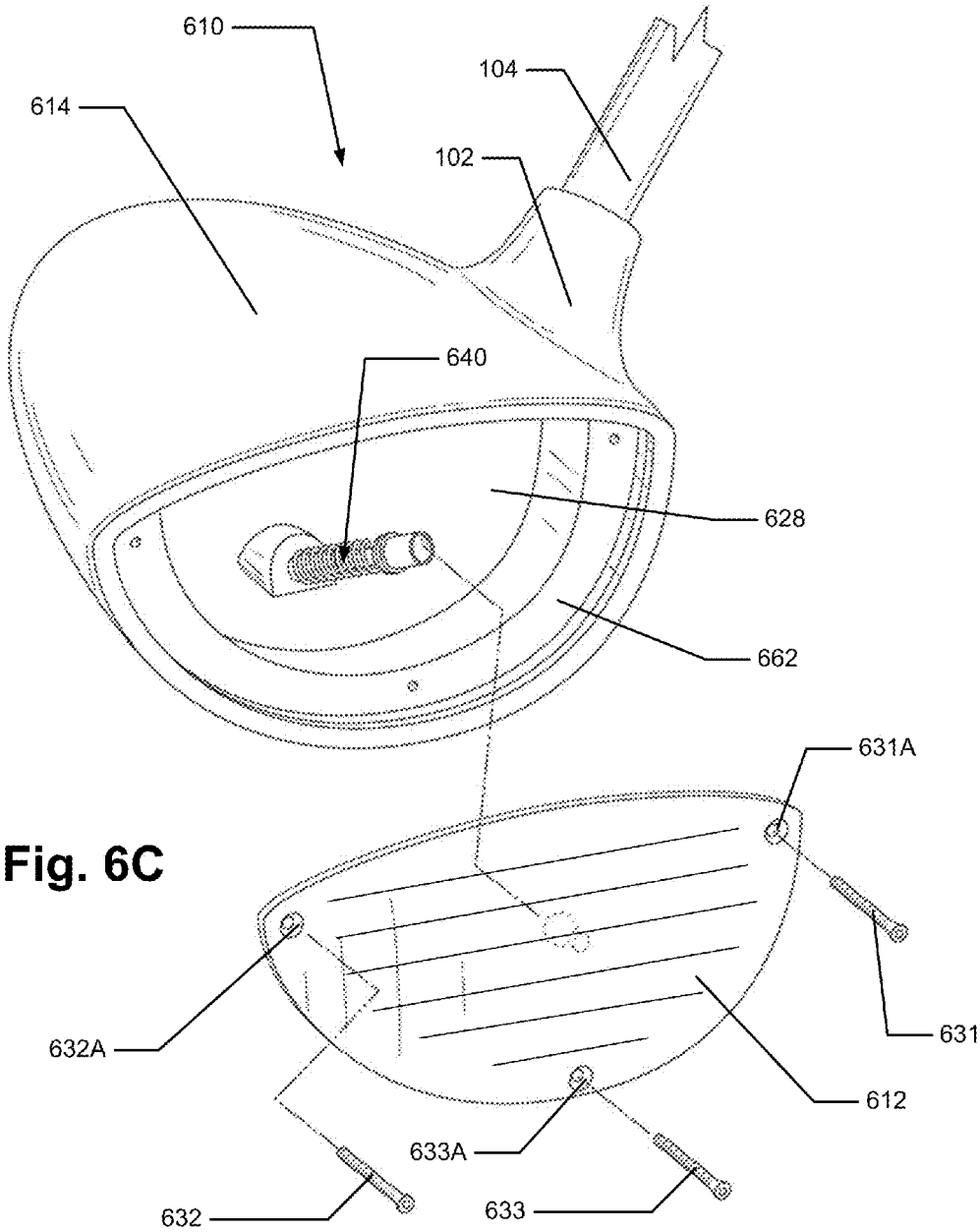

FIGS. 6A through 6C illustrate additional potential features of golf club heads in accordance with at least some examples of this invention. In addition to, or in place of the support blocks as illustrated above in FIGS. 2A through 5, the golf club head 610 may include a face engaging area that includes a support rib 662. The support rib 662 may extend laterally towards the inner cavity 628 from the perimeter of the club head inner body surfaces 636. The support rib 662 may be configured to support the ball striking face 612, when the ball striking face 612 is engaged with or attached to the club head body 614. Additionally, as described more below, the support rib 662 may include attachment means for the ball striking face 612, such as screws 671 672 673 and screw holes 671A 672A 673A, etc. In accordance with this invention, the support rib 662 may be manufactured as an integral component to the club head body 614. In another embodiment in accordance with this invention, the support rib 662 may also be manufactured as a separate member that may be attached to the club head body 614. The support rib 662 may be attached to the club head body 614 in any one of various "engaging" techniques known and used in the art, such as: bonding using adhesives or cements; engaging using welding, brazing soldering, or other fusing techniques; attachment using mechanical connectors including user releasable connectors (such as screws, bolts, nuts, or the like); and the like. The support rib 662 may include one or more metal alloys.

Figure 7:
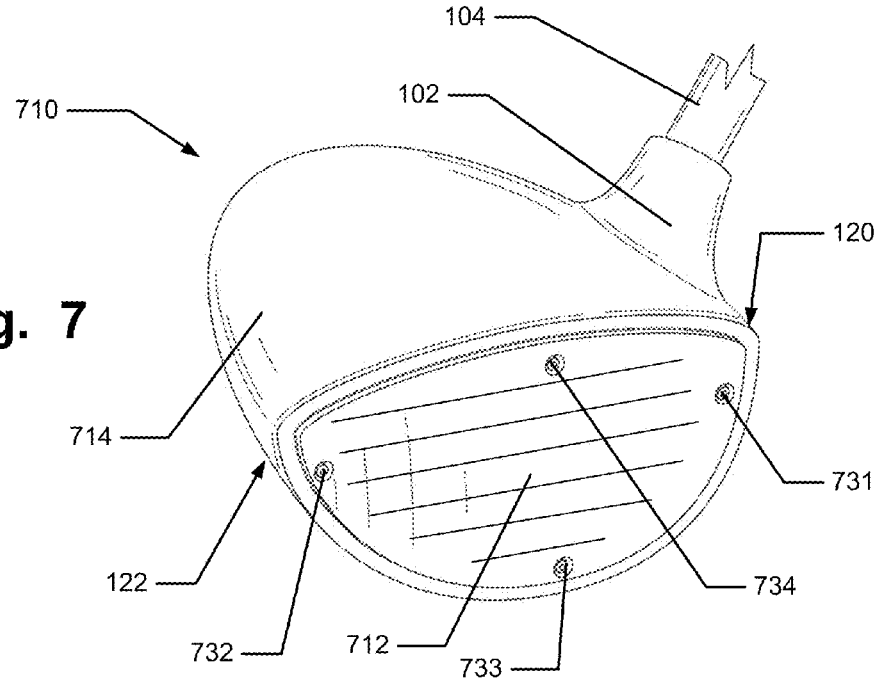
FIGS. 7 and 8 illustrate front perspective views of examples of other golf club heads in accordance with at least some examples of this invention.
Figure 8:
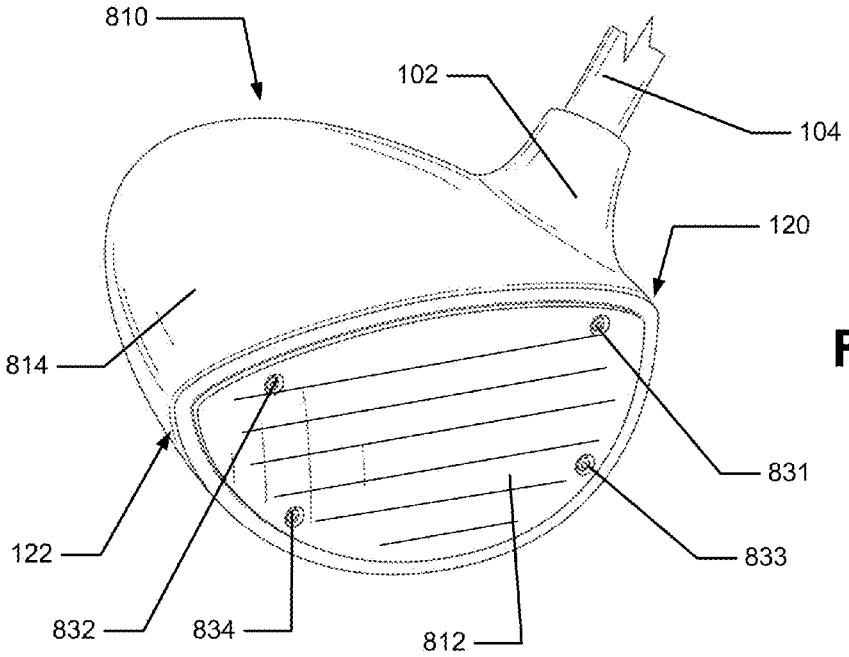

In other example club heads in accordance with this invention, as illustrated in FIGS. 7 and 8, the club head may include a ball striking face that includes a different configuration of adjustment points as is described above and illustrated in FIGS. 2A through 5. For example, as shown in FIG. 7, the club head 710 may include a ball striking face 712 that includes a total of four adjustment points, which include a first adjustment point 731, a second adjustment point 732, a third adjustment point 733, and a fourth adjustment point 734. The first adjustment point 731 may be located approximately at the high-heel area 122 of the ball striking face 712. The second adjustment point 732 may be located approximately at the high-toe area 120 of the ball striking face 712. The third adjustment point 733 may be located approximately at the low-heel area 122 of the ball striking face 712. The fourth adjustment point 734 may be located approximately at the low-toe area 120 of the ball striking face 712. It is understood that the ball striking face 712 can be adjusted from top to bottom and from side to side. Adjustments can also be made using a combination of the adjustment points.

In another example club head 810 in accordance with this invention, as shown in FIG. 8, the club head 810 may include a ball striking face 812 that includes a total of four adjustment points, which include a first adjustment point 831, a second adjustment point 832, a third adjustment point 833, and a fourth adjustment point 834. The first adjustment point 831 may be located approximately at the high-heel area 122 of the ball striking face 812. The second adjustment point 832 may be located approximately at the high-toe area 120 of the ball striking face 812. The third adjustment point 833 may be located approximately between the low-heel area 122 and the low-toe area 120 of the ball striking face 812. The fourth adjustment point 834 may be located approximately between the high-heel area 122 and the high-toe area 120 of the ball striking face 812. It is understood that the ball striking face 712 can be adjusted from top to bottom and from side to side. Adjustments can also be made using a combination of the adjustment points.

For the club heads illustrated in FIGS. 7 and 8, with different adjustment point configurations, the same procedures and principles apply. To adjust the loft angle of the club head, the ball striking face may be adjusted either up or down. To adjust the face angle of the club head, the ball striking face may be adjusted either to the toe or heel side of the club head. Each of these adjustments may be made to the corresponding plurality of adjustment points associated with each adjustment point configuration as illustrated in FIGS. 7 and 8. Additionally, other adjustment point configurations may be utilized on the club head and the ball striking face without departing from this invention.

Figure 10:
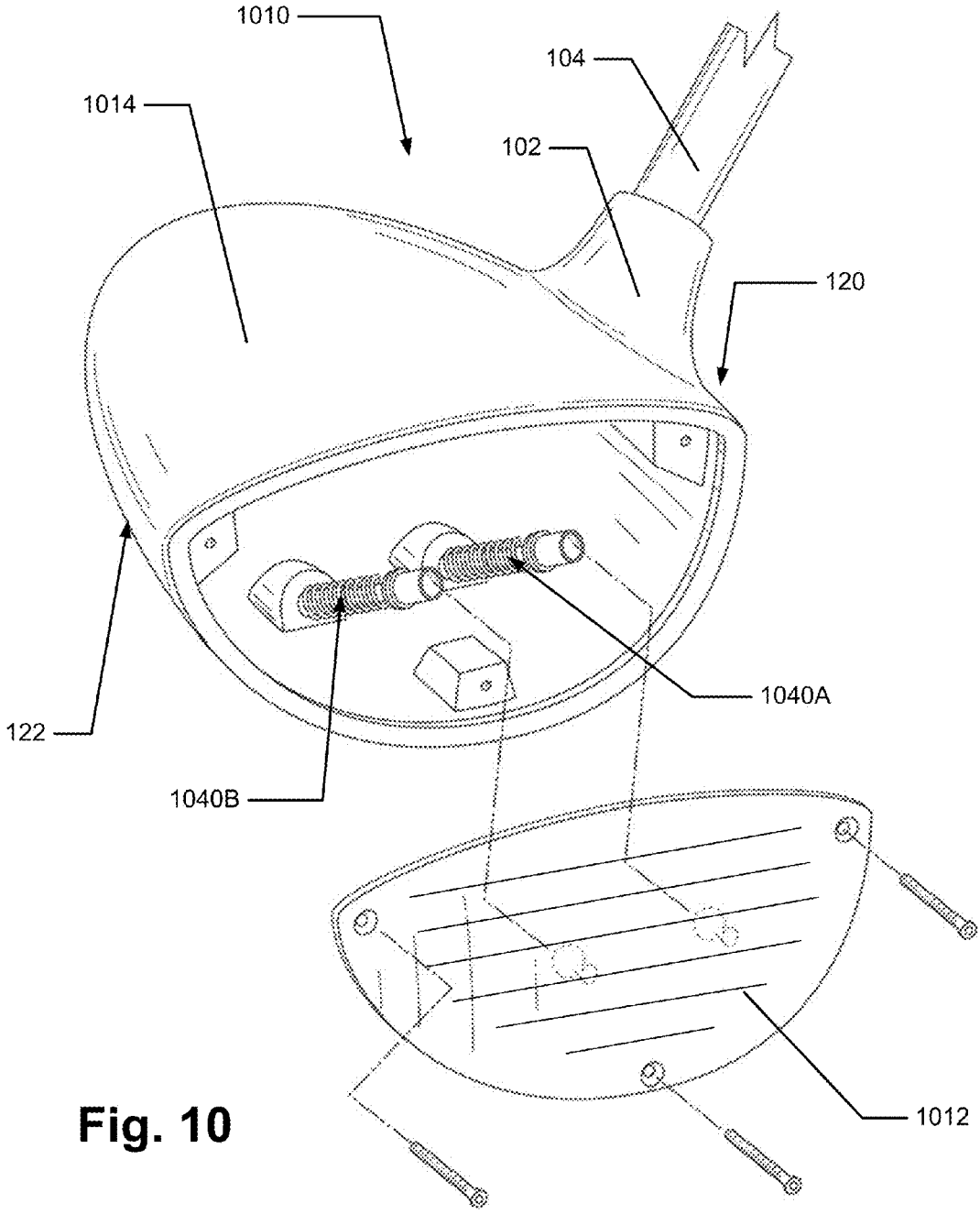
FIG. 10 illustrates a front perspective exploded view of another golf club head in accordance with some examples of this invention.
Figure 11:
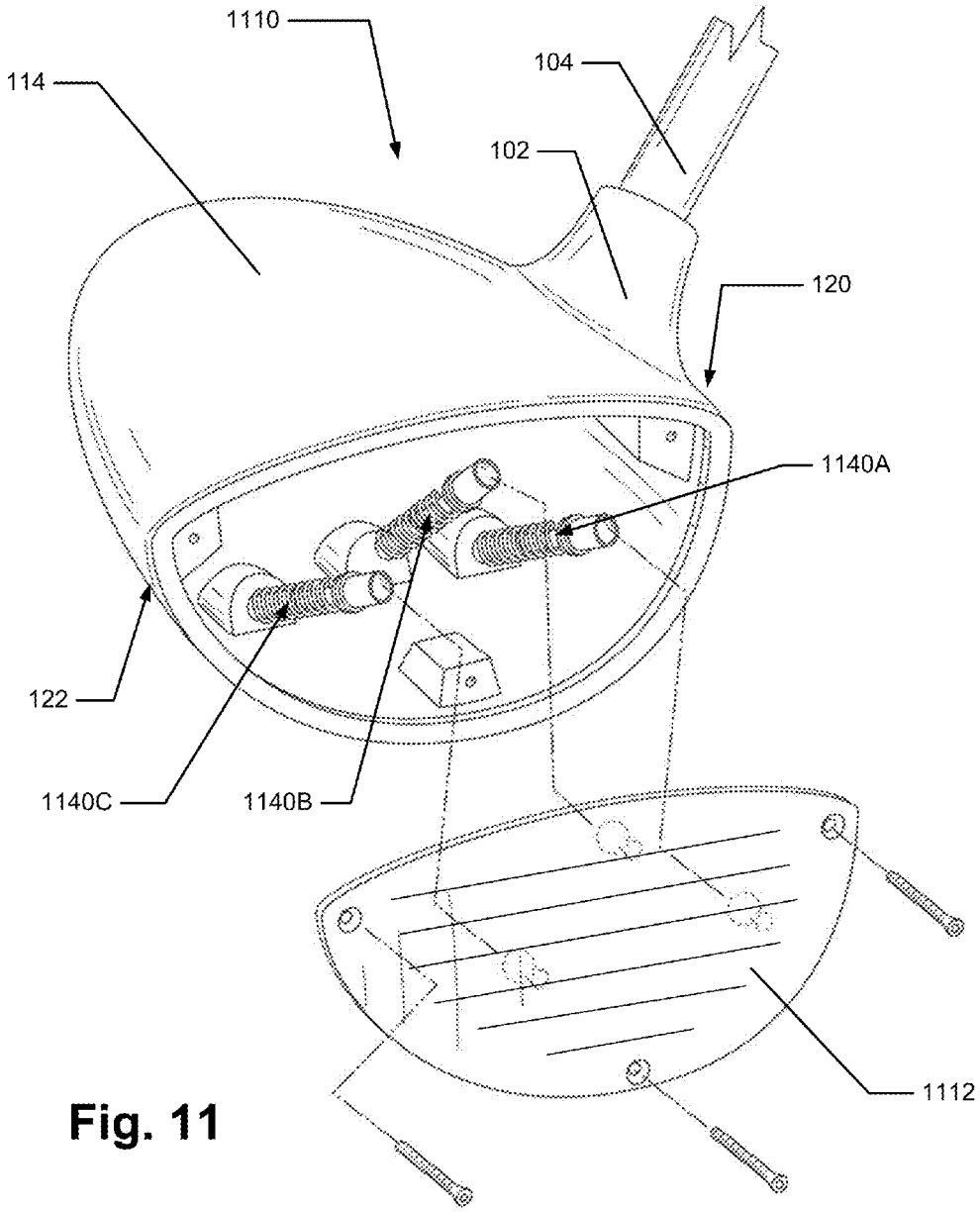
FIG. 11 illustrates a front perspective assembly view of another golf club head in accordance with some examples of this invention.

FIGS. 10 and 11 illustrate additional potential features of golf club heads 1010 1110 in accordance with at least some examples of this invention. These figures illustrate a brace system located at multiple different locations and/or different orientations with respect to a ball striking face 1012 1112 and a club head body 1014 1114. Generally, the brace system may include more than one brace as is illustrated in FIGS. 10 and 11. Additionally, the brace system may have different angular configurations in providing support to the ball striking face 1012 1112.

For example, as shown in FIG. 10, a first brace system 1040A may be located proximate the heel area 120 of the club head structure 1010 (to apply force at the heel area 120 of the ball striking face 1012), and a second brace system 1040B may be located in the toe area 122 of the club head structure 1010 (to apply force at the toe area 122 of the ball striking face 1012). If desired, braces inserted through any of the inlet ports may be sized, shaped, and adapted to extend to any of the desired face contact locations (e.g., so that a brace inserted at the toe end 122 contacts the middle or heel location 120 on the ball striking face 1012).

Another example golf club head 1110 in accordance with this invention, as shown in FIG. 11, includes a first brace system 1140A may be located in the heel area 120 of the club head structure 1110 (to apply force at the heel area 120 of the ball striking face 1112), a second brace system 1140B may be located in the central area of the club head structure 1110, between the heel area 120 and the toe area 122 (to apply force at the central area of the ball striking face 1112), and a third brace system 1140C may be located in the toe area 122 of the club head structure 1110 (to apply force at the toe area 122 of the ball striking face 1112). If desired, braces inserted through any of the inlet ports may be sized, shaped, and adapted to extend to any of the desired face contact locations (e.g., so that a brace inserted at the toe end 122 contacts the middle or heel location 120 on the ball striking face 1112).

An individual club head may have any one or more brace system orientations available, and the user or a club fitter can select which brace system orientation to use for a specific golfer, e.g., based on the contact pattern where the club head face tends to meet the ball. For example, using the club head as illustrated in FIG. 11, if the user predominantly makes contact at the toe end 122 of the ball striking face 1112, use of the heel oriented brace system 1140A may be most appropriate (e.g., to keep the toe end 122 more flexible but to maintain an overall COR response within the limitations of the rules). If the user predominantly makes contact at the heel end 120 of the ball striking face 1112, use of the toe oriented brace system 1140C may be most appropriate (e.g., to keep the heel end 120 more flexible but to maintain an overall COR response within the limitations of the rules). If the user has a very high swing speed or if his or her contact does not fall within a discernible, repeatable pattern, then use of the central brace system 1140B may be the most appropriate (e.g., to provide a backstop to prevent club damage and/or to maintain the ball striking face COR characteristics within the limitations of the rules). The various brace systems may include structure to receive the braces, e.g., in any of the various manners described above, and the various brace systems within a single club head (when multiple brace systems are present) may be the same or different without departing from this invention.

Figure 12:
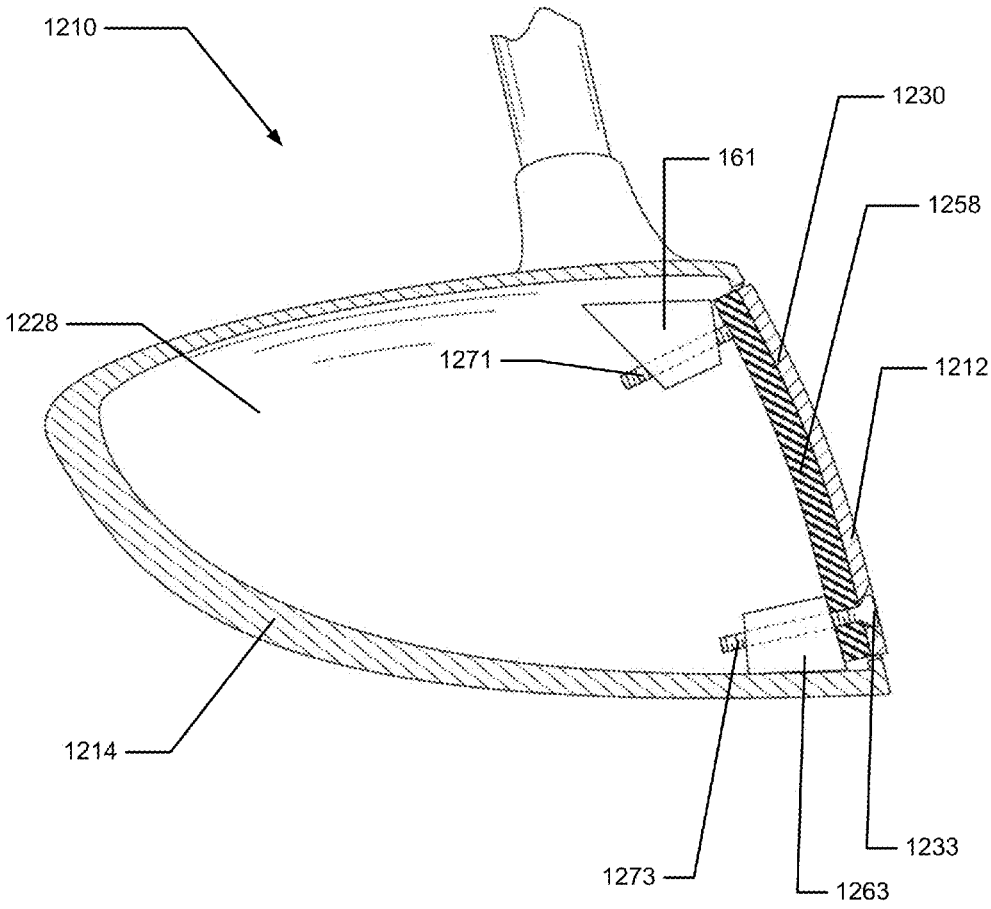
FIG. 12 illustrates a cross-sectional view of another golf club head in accordance with some examples of this invention.

FIG. 12 illustrates additional potential features of golf club heads in accordance with at least some examples of this invention. In addition to, or in place of the support blocks or support ribs as illustrated above in FIGS. 2A through 6C, the golf club head 1210 may include a face engaging area that includes a resilient support member 1258. Additionally, in this embodiment, the golf club head 1210 may not include a brace system as is illustrated above in FIGS. 2A through 5. The resilient support member 1258 may extend laterally towards the inner cavity 1228 from the perimeter of the club head inner body surfaces 1236. The resilient support member 1258 may be configured to support the ball striking face 1212, when the ball striking face 1212 is engaged with or attached to the club head body 1214. Additionally, as described more below, the resilient support member 1258 may include a plurality of adjustment points 1231 1232 1233 that may include attachment means for the inner face surface 1230 of the ball striking face 1212, such as screws 1271 1272 1273 and screw holes 1271A 1272A 1273A, etc.

In accordance with this embodiment, the resilient support member 1258 may be manufactured as a resilient member attached to the club head body 1214. Additionally, the resilient support member 1258 may be attached to a plurality of support blocks 1261 1262 1263 as is similarly illustrated in FIGS. 2A through 5. In another embodiment in accordance with this invention, the resilient support member 1258 may be attached to a support rib as is similarly illustrated in FIGS. 6A through 6C. The resilient support member 1258 may be attached to the club head body 1214 in any one of various "engaging" techniques known and used in the art, such as: bonding using adhesives or cements; engaging sing welding, brazing soldering, or other fusing techniques; attachment using mechanical connectors including user releasable connectors (such as screws, bolts, nuts, or the like); and the like. The resilient support member 1258 may be manufactured in any resilient type of material, for examples rubbers, such as fluorocarbon elastomers, butyl rubber, neoprene, gum rubber, latex rubber, vinyl rubber, or Buna-N rubber.

The resilient support member 1258 may be positioned and oriented (or angled) to provide the desired supporting or bracing and biasing for the adjustable features as described above. The resilient support member 1258 may provide a biasing force to the ball striking face 1212 such that the ball striking face 1212 may be adjustable to a user. The resilient support member 1258 may provide additional support when the ball striking face 1212 is adjusted. The resilient support member 1258 may be engaged such that as the ball striking face 1212 is adjusted up or down and/or left or right, the resilient support rib 1262 contracts or expands to allow the club head 1210 loft angle and/or face angle to be adjusted. The resilient support member 1258 allows movement of the ball striking face 1212 in a plurality of directions. As described above for FIGS. 2A through 5, the resilient support member 1258 may allow the ball striking face 1212 to be adjustable in at least two directions, a left or right direction, which may adjust the face angle of the club head 1210; and an up or down direction, which may adjust the loft angle of the club head 1210.

Additionally, the club head body may contain markings to assist the user when the user is adjusting the face angle and/or the loft angle of the club head 110. These markings may be located on the screws, the support blocks, the support rib, the inner area of the club head body, or any other area which may assist the user in viewing the adjustments.

Additionally, in another embodiment in accordance with this invention, the golf club head may include an alternate bracing system to be included with the golf club heads as shown in FIGS. 2A through 5 and described above. The alternate bracing system may include an electronic/automatic adjustment mechanism in place of the manual adjustment on the ball striking face. The electronic/automatic adjustment mechanism may be a micro-electro-mechanical system (MEMS). The MEMS is operably connected to the ball striking face and may be part of bracing system to include the brace. A user can automatically adjust the bracing system via the MEMS to adjust the face angle and/or the loft angle of the ball striking face on a golf club head. Other adjustment systems may also be utilized such as systems using bi-stable structures as well as other mechanical or electro-mechanical structures.

The golf clubs and golf club heads as described herein provide many benefits and advantages over existing products. For example, the brace can be strategically located and designed to provide local stiffness and local flexibility in the ball striking face of the head so that certain areas of the ball striking face will have a COR response that is higher than other areas, without exceeding COR limits set by regulatory authorities. Golfers and club fitters can take advantage of aspects of this invention by having a user make multiple swings with a golf club and determining the area on the club head face where the golfer tends to make contact with the ball (e.g., using pressure sensitive contact tape). If an area of predominant contact is identified (e.g., the golfer tends to hit the ball in the toe area of the club), a head can be constructed so that the area of the ball striking face that most frequently impacts the ball during play will have a higher COR response. This can be accomplished by locating a contact area and providing a brace at the rear surface of the club head at a location away from the predominant contact area (at the heel area, in this example). A ball impacting these specific locations on the ball striking face (areas located away from the contact area and the brace) will have more energy and velocity transferred to it, thus resulting in longer hits.

An additional advantage of this invention relates to the ability to adjust the club head characteristics from golfer to golfer or even from shot to shot. As was described above, the club head includes a plurality of adjustment points which may be used to adjust the configuration of the ball striking face against the club body. The adjustment points may be adjusted to adjust the ball striking face in the up or down direction, thereby adjusting the loft angle of the club head. For example, golfers and club fitters can take advantage of this aspect of the invention by having a user make multiple swings with a golf club and determining the flight path of the ball after contact with the club head. If the golf ball consistently follows a boring or low shot pattern, the golfer or club fitter can increase the loft angle by adjusting the ball striking face up. Conversely, if the golf ball consistently follows a ballooning or high shot pattern, the golfer or club fitter can decrease the loft angle by adjusting the ball striking face down.

Additionally, the adjustment points may be adjusted to adjust the ball striking face in the left or right direction, thereby adjusting the face angle of the club head. For example, golfers, and club fitters can take advantage of this aspect of the invention by having a user make multiple swings with a golf club and determining the flight path of the ball after contact with the club head. In one example, the golfer consistently slices the ball because, due to a number of swing errors, the golfer delivers the club face to impact with the ball with the ball striking face open to the intended target. This swing causes the ball to slide, then roll, across the ball striking face from the heel toward the toe, which in turn causes the ball to leave the ball striking face with a slicing sidespin action. In accordance with example golf clubs of this invention, the golfer or club fitter can adjust the ball striking face to the left (for a right-handed golfer), thereby closing the ball striking face to the intended target. By changing the club head with a more closed face angle, the number of degrees that the golfer delivers the ball striking face open to impact with the ball is reduced, thereby reducing the slice sidespin imparted on the ball. In another example, the golfer consistently hooks the ball because, due to a number of swing errors, the golfer delivers the club face to impact with the ball with the ball striking face closed to the intended target. This hook swing causes the ball to slide, then roll, across the ball striking face from the toe toward the heel, which in turn causes the ball to leave the ball striking face with a hooking sidespin action. In accordance with example golf clubs of this invention, the golfer or club fitter adjust the ball striking face to the right (for a right-handed golfer), thereby opening the ball striking face to the intended target. By changing the club head with a more opened face angle, the number of degrees that the golfer delivers the ball striking face closed to impact with the ball is reduced, thereby reducing the hook sidespin imparted on the ball.

Additional golf club and golf club heads with reinforced or localized stiffened face portion structures may be used without departing from this invention, such as those shown and described in U.S. patent application Ser. No. 12/430,485 filed Apr. 27, 2009, in the name of John T. Stites, et al., which is incorporated herein by reference in its entirety.

D. Conclusion

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims.

The invention claimed is:

1. A wood-type golf club head, comprising:

a club head body having a front, a crown, a sole, and a face engaging area extending around the outer perimeter of the front of the club head body between the crown and the sole;

a ball striking face having a plurality of adjustment points, wherein the ball striking face is configured for striking a ball with an outer surface thereof, wherein the ball striking face is configured to engage the face engaging area;

a brace extending from the sole to a contact point on an inner surface of the ball striking face, wherein the brace includes a biasing member such that the ball striking face is adjustable in a first direction thereby adjusting a face angle of the club head and adjustable in a second direction thereby adjusting a loft angle of the club head; and a second brace extending from the sole to the inner surface of the ball striking face, wherein the second brace applies a biasing force to the ball striking face.

2. The wood-type golf club head of claim 1, wherein the club head body and the ball striking face define a cavity, and wherein the brace extends through a portion of the cavity between the sole and the ball striking face.

3. The wood-type golf club head of claim 1, wherein the brace further comprises a ball-joint connection located adjacent to the contact point to connect the brace to the ball striking face.

4. The wood-type golf club head of claim 3, wherein the contact point is located approximately in the middle of the ball striking face.

5. The wood-type golf club head of claim 1, wherein the biasing member maintains a constant force applied to the ball striking face when the ball striking face is adjusted in the first direction and the second direction.

6. The wood-type golf club head of claim 5, wherein the biasing member comprises a spring loaded member located adjacent to the sole.

7. The wood-type golf club head of claim 1, wherein the plurality of adjustment points includes a first adjustment point located approximately at a high-heel area of the ball striking face, a second adjustment point located approximately at a high-toe area of the ball striking face, and a third adjustment point located approximately between a low-heel area and a low-toe area of the ball striking face.

8. The wood-type golf club head of claim 1, wherein the plurality of adjustment points includes a first adjustment point located approximately at a high-heel area of the ball striking face, a second adjustment point located approximately at a high-toe area of the ball striking face, a third adjustment point located approximately between a low-heel area and a low-toe area of the ball striking face, and a fourth adjustment point located approximately between the high-heel area and the high-toe area of the ball striking face.

9. The wood-type golf club head of claim 1, wherein each of the plurality of the adjustment points comprises a screw that engages the ball striking face to the face engaging area.

10. The wood-type golf club head of claim 1, wherein the second brace further comprises a second ball-joint connection located adjacent to the ball striking face to connect the second brace to the ball striking face.

11. The wood-type golf club head of claim 10, wherein the second brace further comprises a second spring loaded member located adjacent to the sole.

12. The wood-type golf club head of claim 10, wherein the club head further comprises a third brace extending from the sole to the inner surface of the ball striking face, wherein the third brace provides a biasing force to the ball striking face.

13. The wood-type golf club head of claim 12, wherein the third brace further comprises a second ball-joint connection located adjacent to the ball striking face to connect the third brace to the ball striking face.

14. The wood-type golf club head of claim 13, wherein the third brace further comprises a third spring loaded member located adjacent to the sole.

15. The wood-type golf club head of claim 1, wherein the face engaging area comprises a support rib configured to engage the ball striking face when the ball striking face is attached to the club head.

16. The wood-type golf club head of claim 1, wherein the face engaging area comprises a plurality of support blocks configured to engage the ball striking face when the ball striking face is attached to the club head.

17. The wood-type golf club head of claim 1, wherein the wood-type golf club head is a driver head.

18. The wood-type golf club head of claim 1, wherein the face angle of the club head is adjustable +/−3 degrees.

19. The wood-type golf club head of claim 1, wherein the loft angle of the club head is adjustable +/−5 degrees.

20. A wood-type golf club comprising the wood-type golf club head of claim 1, and a shaft engaged with the wood-type golf club head.

21. The wood-type golf club of claim 20, wherein the wood-type golf club is a driver.

22. A wood-type golf club head, comprising:

a club head body having a front, a crown, a sole, and a support rib extending around the outer perimeter of the front of the club head body between the crown and the sole;

a ball striking face having a plurality of adjustment points, wherein the ball striking face is configured for striking a ball with an outer surface thereof, wherein the ball striking face is configured to engage the support rib;

a brace extending from the sole to an inner surface of the ball striking face, wherein the brace includes:

an end portion engaged with the inner surface of the ball striking face, a fixed rod located between the end portion and an inner surface of the club head at the sole, wherein the fixed rod also includes a retractable rod located within the fixed rod, and a biasing member attached to the retractable rod, wherein the biasing member surrounds at least a portion of the fixed rod and provides a biasing force to the ball striking face such that the ball striking face is adjustable in a first direction thereby adjusting a face angle of the club head and adjustable in a second direction thereby adjusting a loft angle of the club head.

23. The wood-type golf club head of claim 22, wherein the club head body and the ball striking face define a cavity, and wherein the brace extends through a portion of the cavity between the sole and the ball striking face.

24. The wood-type golf club head of claim 22, wherein the end portion further comprises a ball-joint connection located adjacent to the inner surface of the ball striking face to connect the brace to the ball striking face.

25. The wood-type golf club head of claim 22, wherein the biasing member maintains a constant force applied to the ball striking face when the ball striking face is adjusted in the first direction and the second direction.

26. The wood-type golf club head of claim 25, wherein the biasing member comprises a spring loaded member.

27. The wood-type golf club head of claim 22, wherein the plurality of adjustment points includes a first adjustment point located approximately at a high-heel area of the ball striking face, a second adjustment point located approximately at a high-toe area of the ball striking face, and a third adjustment point located approximately between a low-heel area and a low-toe area of the ball striking face.

28. The wood-type golf club head of claim 22, wherein the plurality of adjustment points includes a first adjustment point located approximately at a high-heel area of the ball striking face, a second adjustment point located approximately at a high-toe area of the ball striking face, a third adjustment point located approximately between a low-heel area and a low-toe area of the ball striking face, and a fourth adjustment point located approximately between the high-heel area and the high-toe area of the ball striking face.

29. The wood-type golf club head of claim 22, wherein each of the plurality of the adjustment points comprises a screw that engages the ball striking face to the face engaging area.

30. The wood-type golf club head of claim 22, wherein the face angle of the club head is adjustable +/−3 degrees.

31. The wood-type golf club head of claim 22, wherein the loft angle of the club head is adjustable +/−5 degrees.

32. A wood-type golf club comprising the wood-type golf club head of claim 22, and a shaft engaged with the wood-type golf club head.

33. The wood-type golf club of claim 32, wherein the wood-type golf club is a driver.

* * * * *